US012569732B2

(12) United States Patent
Parsons et al.

(10) Patent No.: US 12,569,732 B2
(45) **Date of Patent: *Mar. 10, 2026**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Matthew T. Andrews, Scottsdale, AZ (US); Bradley D. Schweigert, Cave Creek, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/292,388

(22) Filed: Aug. 6, 2025

(65) Prior Publication Data

US 2025/0360382 A1 Nov. 27, 2025

Related U.S. Application Data

(63) Continuation of application No. 19/189,574, filed on Apr. 25, 2025, now Pat. No. 12,397,205, which is a (Continued)

(51) Int. Cl.

| | |
|---|---|
| ***A63B 53/04*** | (2015.01) |
| ***A63B 53/06*** | (2015.01) |
| ***A63B 60/02*** | (2015.01) |

(52) U.S. Cl.

CPC ..... *A63B 53/0487* (2013.01); *A63B 53/065* (2013.01); *A63B 60/02* (2015.10); (Continued)

(58) Field of Classification Search

CPC ..... A63B 53/007; A63B 53/02; A63B 53/021; A63B 53/0487; A63B 53/065

See application file for complete search history.

(56) References Cited

U.S. PATENT DOCUMENTS

| | | | |
|---|---|---|---|
| 807,224 | A | 12/1905 | Vaile |
| 3,497,220 | A | 2/1970 | Scott |

(Continued)

FOREIGN PATENT DOCUMENTS

| | | | |
|---|---|---|---|
| JP | H09164229 | A | 6/1997 |
| JP | 3111030 | B2 | 11/2000 |

OTHER PUBLICATIONS

Evnroll. "Zero Z.1 Mallet Putter in Black, Red, or Blue (Zero Torque)." Evnroll, n.d. https://www.evnroll.com/products/zero-z1-mallet-putter (accessed May 6, 2025).

*Primary Examiner* — Michael D Dennis

(57) ABSTRACT

Embodiments of golf club heads and methods to manufacture golf club heads are generally described herein. In one example, a golf club head includes an alignment aid coinciding with a center longitudinal plane. A center of gravity is located on a horizontal plane parallel to a ground plane. A hosel portion includes a bend portion. The hosel portion imparts forward shaft lean and orients a shaft axis to intersect the horizontal plane at an intersection point that is offset from the center of gravity. A visibility angle no greater than 20 degrees is formed between the center longitudinal plane and a visibility plane bordering the bend portion and intersecting the center longitudinal plane at the alignment aid. The visibility angle represents a range of sightlines that enable an individual to fully see the alignment aid at an address position. Other examples and embodiments may be described and claimed.

20 Claims, 27 Drawing Sheets

Related U.S. Application Data continuation-in-part of application No. 18/423,608, filed on Jan. 26, 2024, now Pat. No. 12,303,753, which is a continuation of application No. 18/241,633, filed on Sep. 1, 2023, now Pat. No. 11,918,869, which is a continuation-in-part of application No. 18/219,215, filed on Jul. 7, 2023, now Pat. No. 11,839,801.

(60) Provisional application No. 63/708,955, filed on Oct. 18, 2024, provisional application No. 63/672,521, filed on Jul. 17, 2024, provisional application No. 63/525,847, filed on Jul. 10, 2023, provisional application No. 63/524,452, filed on Jun. 30, 2023, provisional application No. 63/470,711, filed on Jun. 2, 2023.

(52) U.S. Cl.
CPC ..... *A63B 53/0408* (2020.08); *A63B 53/0437* (2020.08); *A63B 53/0441* (2020.08); *A63B 53/0466* (2013.01); *A63B 53/047* (2013.01); *A63B 2053/0491* (2013.01)

(56) References Cited

U.S. PATENT DOCUMENTS

| | | | | |
|---|---|---|---|---|
| 4,163,554 | A | 8/1979 | Bernhardt | |
| 4,265,451 | A | 5/1981 | Bernhardt | |
| 5,078,398 | A * | 1/1992 | Reed | A63B 53/0487 273/DIG. 8 |
| 5,228,332 | A | 7/1993 | Bernhardt | |
| 5,454,564 | A | 10/1995 | Kronogard | |
| 6,083,113 | A | 7/2000 | Bernhardt | |
| 6,776,727 | B1 | 8/2004 | Engdahl | |
| 7,066,829 | B1 | 6/2006 | Lister | |
| 7,473,189 | B2 | 1/2009 | Schweigert et al. | |
| 7,494,422 | B2 | 2/2009 | Pegg | |
| 7,722,476 | B2 | 5/2010 | Pedraza et al. | |
| 7,857,710 | B2 | 12/2010 | Pedraza | |
| 7,909,707 | B2 | 3/2011 | Klein | |
| 8,016,693 | B2 | 9/2011 | Pedraza | |
| 9,233,280 | B2 | 1/2016 | Presse, IV et al. | |
| 9,375,615 | B2 | 6/2016 | Park | |
| 10,166,445 | B2 | 1/2019 | Brandt | |
| 11,458,375 | B2 | 10/2022 | Higdon et al. | |
| 11,826,621 | B2 | 11/2023 | Pedraza | |
| 2002/0151376 | A1 | 10/2002 | Verne | |
| 2005/0250595 | A1 | 11/2005 | Stevenson, Jr. | |
| 2009/0042666 | A1 * | 2/2009 | Pedraza | A63B 60/02 473/340 |
| 2014/0100053 | A1 | 4/2014 | Stokke et al. | |
| 2015/0080148 | A1 * | 3/2015 | Cameron | A63B 53/007 473/340 |
| 2015/0119160 | A1 | 4/2015 | Franklin | |
| 2016/0101327 | A1 | 4/2016 | Stokke et al. | |
| 2019/0175995 | A1 | 6/2019 | Kroloff et al. | |
| 2020/0001150 | A1 | 1/2020 | Matthesen | |
| 2022/0152464 | A1 | 5/2022 | Pedraza | |

* cited by examiner

GOLF CLUB HEADS AND METHODS TO MANUFACTURE GOLF CLUB HEADS

CROSS REFERENCE

This application is a continuation of application Ser. No. 19/189,574, filed Apr. 25, 2025, which claims the benefit of U.S. Provisional Application No. 63/708,955, filed Oct. 18, 2024, and claims the benefit of U.S. Provisional Application No. 63/708,955, filed Oct. 18, 2024.

U.S. application Ser. No. 19/189,574, filed Apr. 25, 2025 is a continuation-in-part of U.S. application Ser. No. 18/423,608, filed Jan. 26, 2024, now U.S. Pat. No. 12,303,753, which is a continuation of U.S. application Ser. No. 18/241,633, filed Sep. 1, 2023, now U.S. Pat. No. 11,918,869, which claims the benefit of U.S. Provisional Application No. 63/525,847, filed Jul. 10, 2023.

U.S. application Ser. No. 18/241,633, filed Sep. 1, 2023, is a continuation-in-part of U.S. application Ser. No. 18/219,215, filed Jul. 7, 2023, now U.S. Pat. No. 11,839,801, which claims the benefit of U.S. Provisional Application No. 63/524,452, filed Jun. 30, 2023, and the benefit of U.S. Provisional Application No. 63/470,711, filed Jun. 2, 2023.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacture golf club heads.

BACKGROUND

Golf club heads may be configured with a variety of mass properties. By offsetting a center of gravity and a shaft axis, certain mass properties of a golf club head may be optimized to improve performance.

Figure 1:
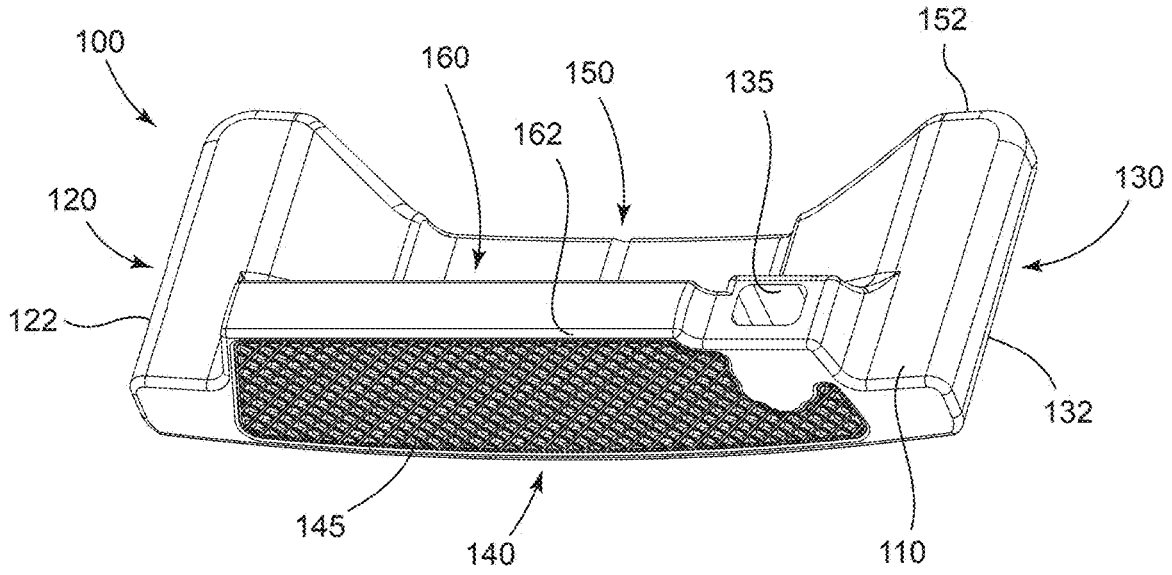
FIGS. 1, 2, 3, 4, 5, 6, 7, 8, and 9 depict a perspective front view, an exploded bottom perspective view, a front elevational view, a rear elevational view, an exploded rear perspective view, a perspective cross-sectional view (along line 6-6 of FIG. 4), a perspective cross-sectional view (along line 7-7 of FIG. 4), a perspective cross-sectional view (along line 8-8 of FIG. 4), and a perspective cross-sectional view (along line 9-9 of FIG. 4), respectively, of a golf club head according to an embodiment of the apparatus, methods, and articles of manufacture described herein.
Figure 2:
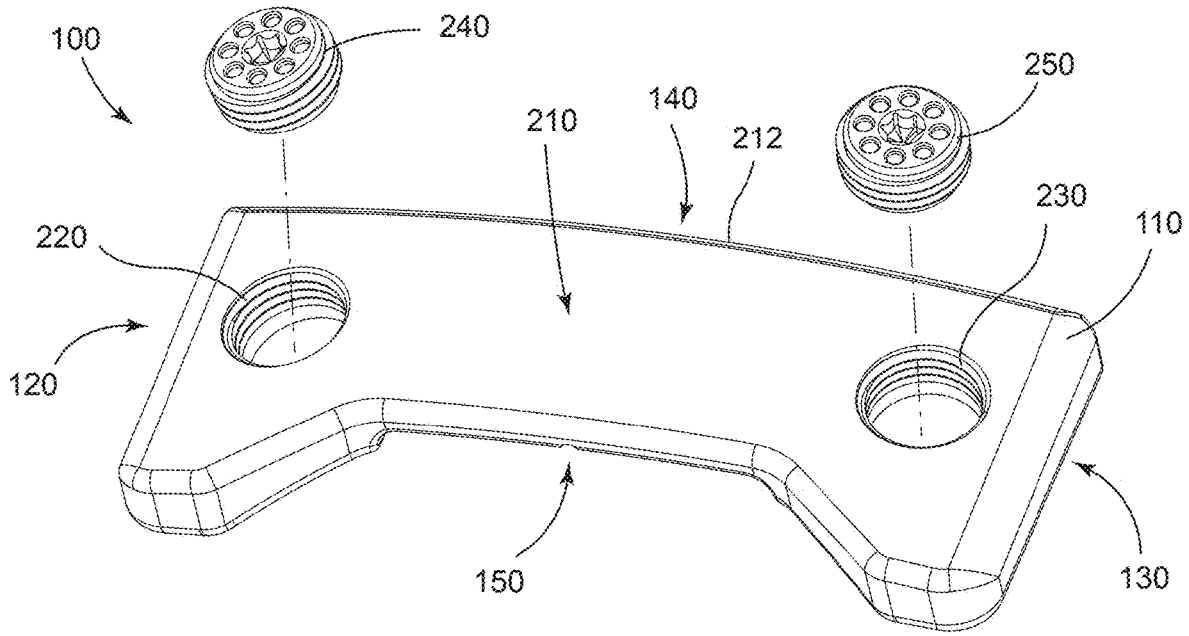
Figure 3:
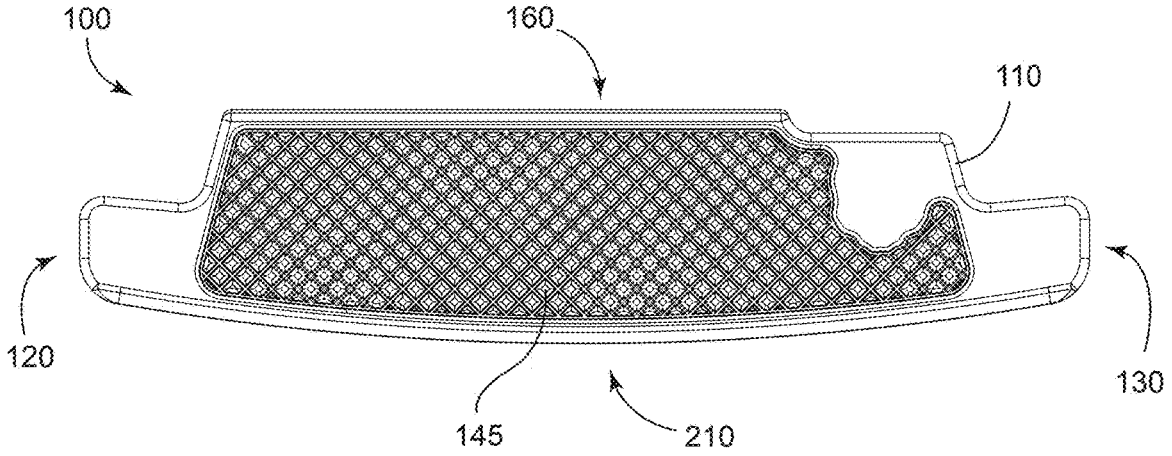
Figure 4:
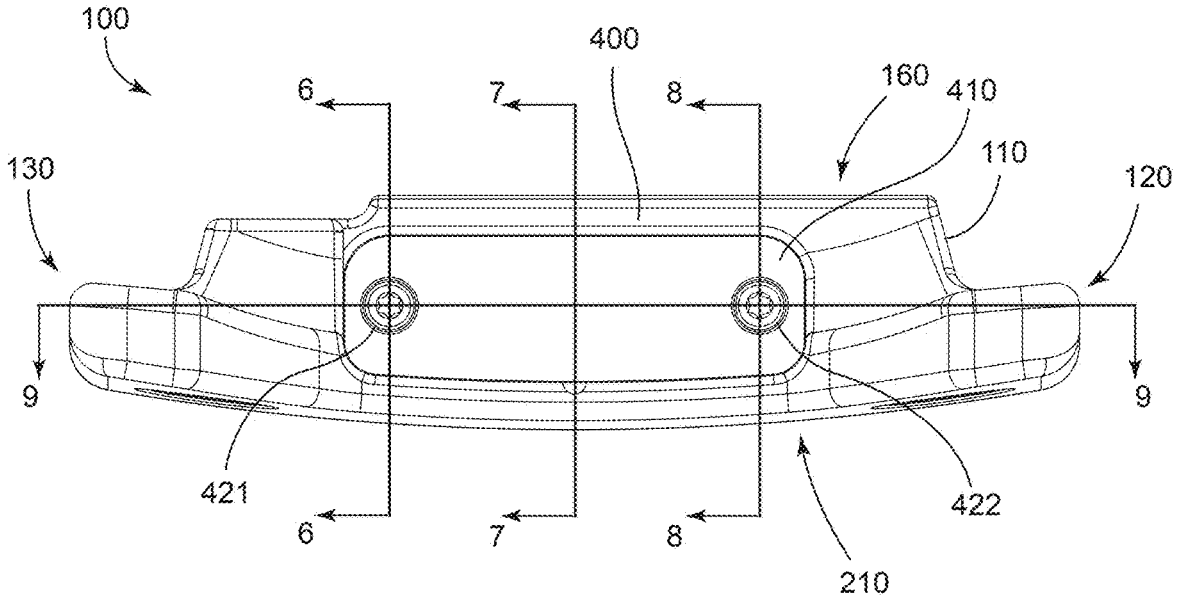
Figure 5:
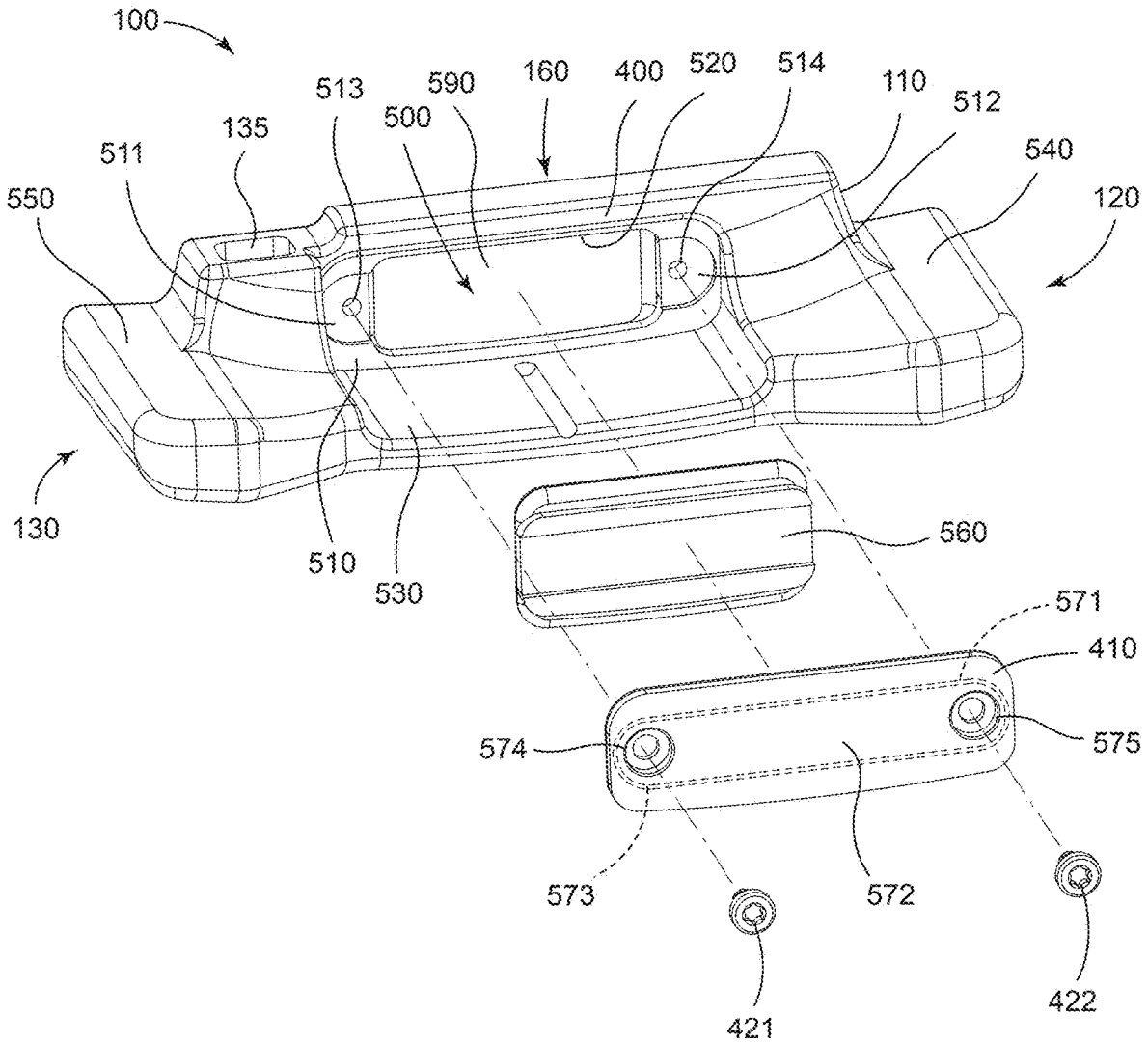
Figure 6:
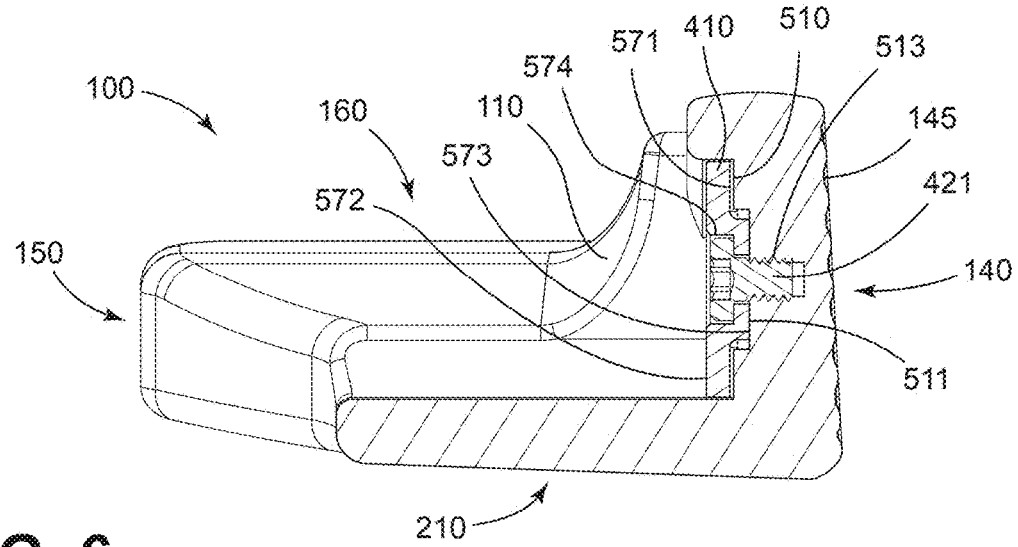

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. Patents and Patent Applications, which are collectively referred to herein as "the incorporated by reference patent documents." are incorporated by reference herein in their entirety: U.S. Pat. Nos. 9,233,283; 9,387,375; 9,440,124; 9,649,540; 9,895,585; 10,478,680; 10,493,331; 10,576,339; 10,737,153; 10,821,341; 10,960,271; 10,981,038; 11,045,698; 11,298,597; 11,369,849; and 11,517,798; and U.S. Patent Publication Nos. 20180200589 and 20220219054.

In general, golf club heads and methods to manufacture golf club heads are described herein. The apparatus, methods, and articles of manufacture described herein are not limited in this regard.

In the example of FIGS. 1-9, a golf club head 100 is generally shown as a first type of blade putter. The golf club head 100 may include a body portion 110 made from any of the materials described herein or described in any of the incorporated by reference patent documents. The body portion 110 may have a toe portion 120, a heel portion 130 opposite the toe portion 120, a hosel bore 135 located at the heel portion 130, a front portion 140, a face portion 145 located at the front portion 140, a rear portion 150 opposite the front portion 140, a top portion 160, and a sole portion 210 opposite the top portion 160. The toe portion 120 may include a toe portion edge 122, the heel portion 130 may include a heel portion edge 132, the rear portion 150 may include a rear portion edge 152, the top portion 160 may include a top portion edge 162, and the sole portion 210 may include a sole portion edge 212. The body portion 110 may be manufactured via various manufacturing methods and/or processes (e.g., a casting process, a forging process, a milling process, a cutting process, a grinding process, a welding process, a 3D printing process, a combination thereof, etc.). The body portion 110 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 110 may be partially or entirely made of a non-metal material (e.g., composite, plastic, etc.). The apparatus, methods, and articles of manufacture described herein are not limited in this regard.

The face portion 145 may define a front surface of the body portion 110 for striking a golf ball. The face portion 145 may be generally planar and may have a loft angle greater than or equal to two degrees and less than or equal to four degrees. The sole portion 210 may include a plurality of weight ports (e.g., shown as a toe-side weight port 220 and a heel-side weight port 230) each configured to receive a complementary weight portion (e.g., shown as weight portions 240 and 250). Weight portions 240 and 250 may be configured as interchangeable screws threadedly coupled to the toe-side weight port 220 and the heel-side weight port 230, respectively. Weight portions 240 and 250 may be made from any of the materials described herein and may have similar or different material compositions and/or physical properties (e.g., density, color, texture) with respect to each other and the body portion 110. The hosel bore 135 may be configured to receive a variety of hosel types to accommodate a variety of swing types. The configuration and/or properties of each of the weight ports and the weight portions may be similar in many respects to any of the weight ports and weight portions, respectively, described in any of the incorporated by reference patent documents. The apparatus, methods, and articles of manufacture described herein are not limited in this regard.

The golf club head 100 may include an interior cavity 500 within the body portion 110. The interior cavity 500 may be located between the face portion 145 and a back wall portion 400 disposed opposite the face portion 145. The back wall portion 400 may extend between the toe portion 120 and the heel portion 130 and may include a recessed portion 510 defining an opening 520 that interfaces with the interior cavity 500. The recessed portion 510 may be located adjacent a ledge portion 530 at or proximate the rear portion 150 and extending between a toe-side mass platform 540 and a heel-side mass platform 550. In the example of FIGS. 1-9, the ledge portion 530 may be recessed relative to the toe-side mass platform 540 and the heel-side mass platform 550. The interior cavity 500 may be partially or entirely filled with a filler material 560. The filler material 560 may be any type of polymer material described herein or described in any of the incorporated by reference patent documents. In one example, the filler material 560 may include a low-density polymer material. In another example, the filler material 560 may be a solid piece manufactured in the shape of the interior cavity 500 so as to be insertable into the interior cavity 500 through the opening 520. In yet another example, the filler material 560 may be an injectable liquid or fluid material provided to the interior cavity 500 via the opening 520 and later hardened at ambient conditions or during a curing process. The golf club head 100 may include a cover portion shown for example as back plate 410 that may be coupled to the body portion 110 to close the opening 520 and to enclose the interior cavity 500. The apparatus, methods, and articles of manufacture described herein are not limited in this regard.

The back plate 410 may have a complementary shape to the recessed portion 510. The back plate 410 may include a front surface 571, a rear surface 572, and a stiffening member 573. In one example, as illustrated in FIGS. 1-9, the stiffening member 573 may be configured as an elongated rib or protrusion extending longitudinally across the front surface 571 of the back plate 410. The back plate 410 may be joined to the body portion 110 such that the front surface 571 of the back plate 410 contacts the recessed portion 510 and the end portions of the stiffening member 573 are each received in a complementary indent (e.g., shown as indents 511 and 512) in the recessed portion 510. In the present example, the stiffening member 573 may extend across the opening 520 in a toe-to-heel direction of the golf club head 100. Indents 511 and 512 may each include a fastener port (e.g., shown as fastener ports 513 and 514) concentrically aligned with a complementary through-port (e.g., shown as through-ports 574 and 575) extending through the rear surface 572 and the stiffening member 573 of the back plate 410. The back plate 410 may be attached to the body portion 110 via a first mechanical fastener 421 inserted in through-port 574 and threadedly engaged to fastener port 513 and a second mechanical fastener 422 inserted in through-port 575 and threadedly engaged to fastener port 514. In another example, only an adhesive may be used to join the front surface 571 of the back plate 410 to the recessed portion 510.

In yet another example, fasteners and one or more adhesives may be used to join the front surface 571 of the back plate 410 to the recessed portion 510. In operation, the stiffening member 573 may impart structural rigidity to the back plate 410 and may also compress the filler material 560 against a rear surface 590 of the face portion 145. The back plate 410 may be made from any of the materials described herein or described in any of the incorporated by reference patent documents. The apparatus, methods, and articles of manufacture described herein are not limited in this regard.

The filler material 560 may contact and reinforce the rear surface 590 of the face portion 145 to reduce face deformation and also dampen sound and vibration. The filler material 560 may also encase a portion of the stiffening member 573 extending across the opening 520 to help maintain the back plate 410 in place. The rear surface 590 of the face portion 145 may include a rear surface of a central strike portion 700 of the face portion 145. The central strike portion 700 may correspond to a portion of the face portion 145 bisected by a center longitudinal plane 900 of the golf club head 100 and may extend a length 910 between the toe portion 120 and the heel portion 130. In one example, the length 910 of the central strike portion 700 may be greater than or equal to 1.00 inch (25.4 mm) and less than or equal to 1.70 inch (43.18 mm). In another example, the length 910 of the central strike portion 700 may be greater than or equal to 1.20 inches (30.48 mm) and less than or equal to 1.70 inch (43.18 mm). In yet another example, the length 910 of the central strike portion 700 may be greater than or equal to 1.40 inches (35.56 mm) and less than or equal to 1.70 inch (43.18 mm). The apparatus, methods, and articles of manufacture described herein are not limited in this regard.

Figure 7:
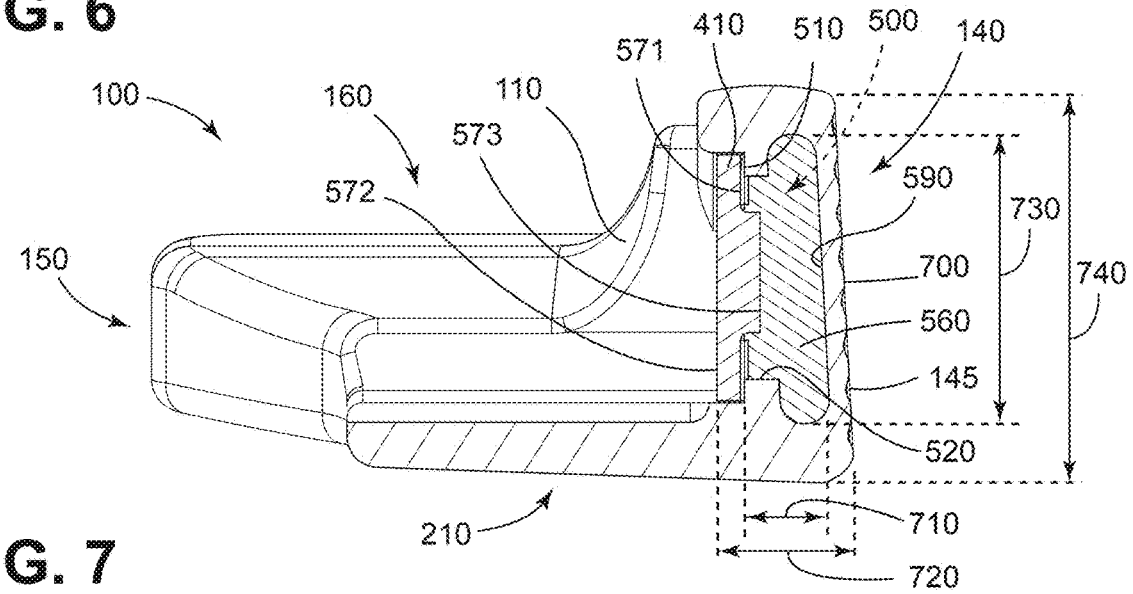
Figure 8:
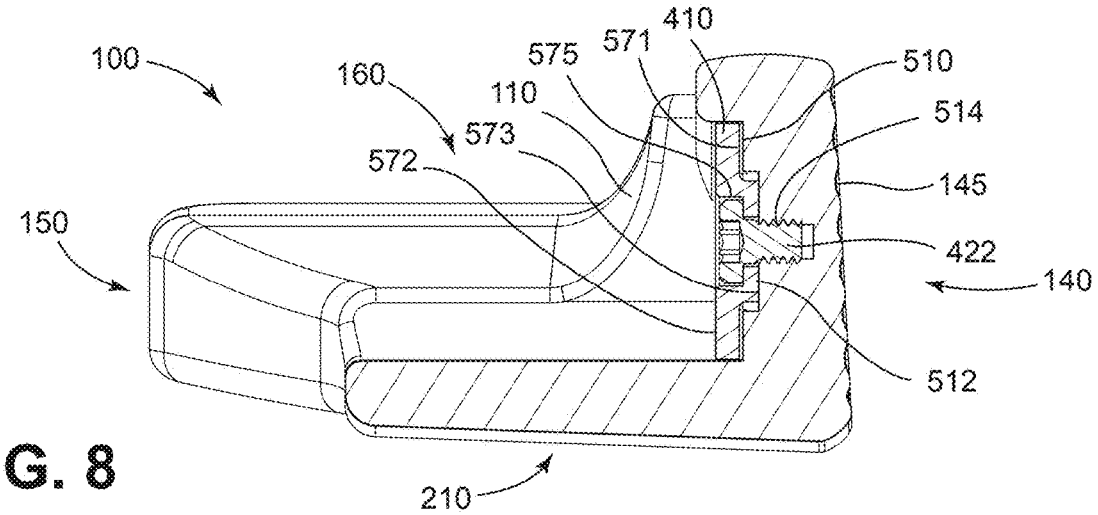
Figure 9:
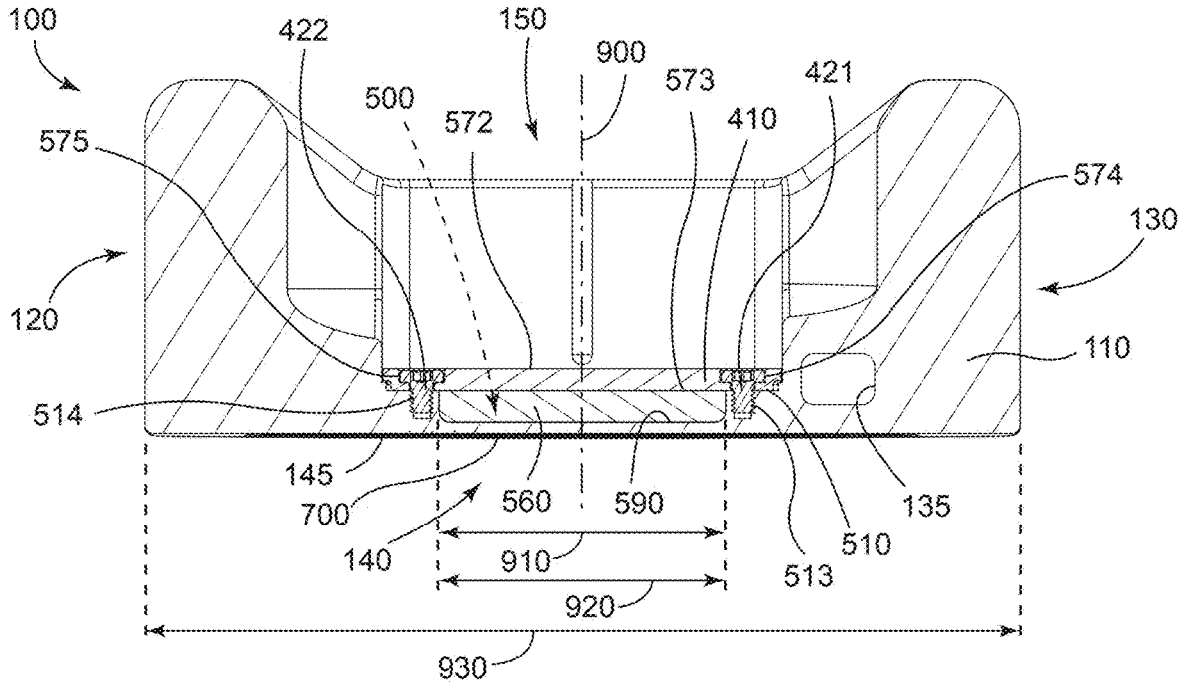

In one example, as illustrated in FIG. 7, the golf club head 100 may have at least one cross-section where the filler material 560 has a length 710 in a front-to-rear direction greater than or equal to 40% of a length 720 between the front surface of the face portion 145 and the rear surface 572 of the back plate 410. With continued reference to FIG. 7, the golf club head 100 may have at least one cross-section where the filler material 560 has a length 730 in a top-to-sole direction greater than or equal to 70% of a length 740 of the body portion 110 in the top-to-sole direction. With reference to FIG. 9, the golf club head 100 may have at least one cross-section where the filler material 560 has a length 920 in a toe-to-heel direction greater than or equal to the length 910 of the central strike portion 700 and/or greater than or equal to 30% of a length 930 of the body portion 110 in the toe-to-heel direction. The apparatus, methods, and articles of manufacture described herein are not limited in this regard.

The filler material 560 may have a density less than a density of the body portion 110 so that more discretionary mass may be allocated to other areas of the golf club head 100. With respect to the present example, the filler material 560 may have a fill volume ($V_f$) greater than or equal to 6% and less than or equal to 10% of a total volume ($V_t$) of the golf club head 100 and a fill mass ($M_f$) greater than or equal to 0.5% and less than or equal to 1% of a total mass ($M_t$) of the golf club head 100. In one example, the total volume ($V_t$) of the golf club head 100 may be greater than or equal to 2.50 inch$^3$ (40.968 cm$^3$) and less than or equal to 3.00 inch$^3$ (49.161 cm$^3$) and the total mass ($V_t$) of the golf club head 100 may be greater than or equal to 300 grams and less than or equal to 345 grams. Selecting the filler material 560 from a lightweight or low-density material and increasing the fill volume ($V_f$) of the filler material 560 relative to the total volume ($V_t$) of the golf club head 100 may enable greater discretionary mass placement toward a periphery of the golf club head 100 to optimize certain mass properties of the golf club head 100 such as moment of inertia (MOI), center of gravity (CG) location, and mass balance while maintaining a suitable club head weight. With respect to any of the examples described herein, a periphery of a golf club head may include the perimeter portions of the toe portion. the heel portion, and the rear portion, respectively. As defined herein, a ratio between a percentage fill volume $$\left(\frac{Vf}{Vt} \times 100\right)$$

and a percentage fill mass $$\left(\frac{Mf}{Mt} \times 100\right)$$

of a filler material may be indicative of the level of freedom in which discretionary mass may be distributed to other areas of a golf club head. Said differently, the ratio between a percentage fill volume and a percentage fill mass of a filler material may correspond to the percentage fill volume divided by the percentage fill mass and a larger ratio value may signify a greater degree of freedom in discretionary mass placement. In one example, the filler material 560 may have a ratio between a percentage fill volume and a percentage fill mass of a filler material that may be greater than or equal to 6.00 and the golf club head 100 may have a MOI greater than or equal to 4500 g·cm$^2$. In another example, the golf club head 100 may have a MOI greater than or equal to 4700 g·cm$^2$. In yet another example, the golf club head 100 may have a MOI greater than or equal to 5000 g·cm$^2$. The apparatus, methods, and articles of manufacture described herein are not limited in this regard.

Figure 10:
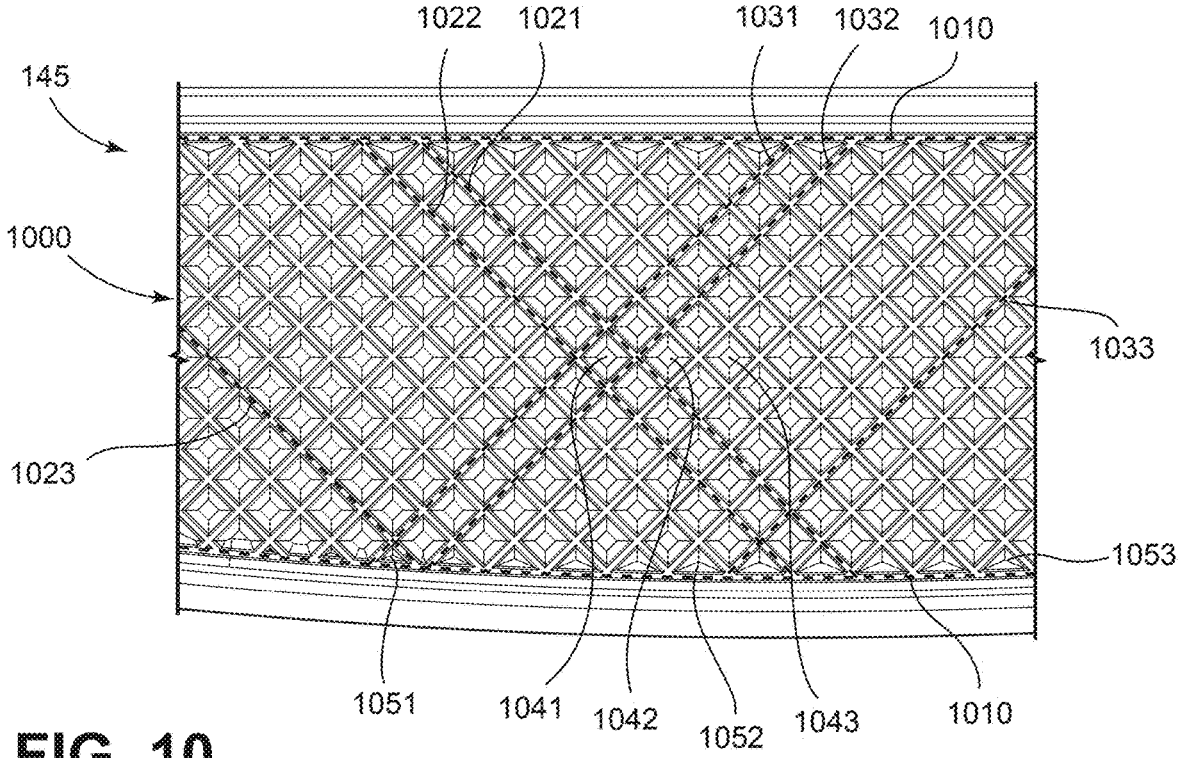
FIG. 10 depicts an enlarged schematic front view of a face portion of the golf club head of FIGS. 1-9 according to an embodiment of the apparatus, methods, and articles of manufacture described herein.

The golf club head 100 may have thin cavity walls to provide additional discretionary mass to be allocated to other areas of the golf club head 100 compared to conventional solid-body golf club heads. For example, one or more cavity walls may have a thickness (constant or average) greater than or equal to 0.035 inch (0.889 mm) and less than or equal to 0.060 inch (1.524 mm). In particular, the face portion 145 may define a thin front cavity wall reinforced by the filler material 560. Accordingly, the structural support provided by the filler material 560 may allow for having relatively thinner face portion and cavity walls. With reference to FIG. 10, the face portion 145 may include a plurality of grooves 1000 defined by a perimeter groove 1010, a first plurality of grooves (e.g., shown as grooves 1021, 1022, and 1023), and a second plurality of grooves (e.g., shown as grooves 1031, 1032, and 1033). In the example of FIG. 10, dashed lines have been overlaid onto the perimeter groove 1010 and the example grooves for case of reference and purposes of understanding. In the illustrated example, the perimeter groove 1010 may define a boundary enclosing the first plurality of grooves and the second plurality of grooves. The first plurality of grooves may be arranged in parallel with one another and may extend in a first diagonal direction across face portion 145 within the boundary set by the perimeter groove 1010. The second plurality of grooves may be arranged in parallel with one another and may extend in a second diagonal direction within the boundary set by the perimeter groove 1010. Each groove of the first plurality of grooves and the second plurality of grooves may terminate at the perimeter groove 1010. In other words, the first plurality of grooves and the second plurality of grooves may be joined to the perimeter groove 1010 at their terminal ends. In one example, the first plurality of grooves may be transverse to the second plurality of grooves. Accordingly, the first plurality of grooves may intersect with the second plurality of grooves at right angles. The apparatus, methods, and articles of manufacture described herein are not limited in this regard.

With continued reference to FIG. 10, the plurality of grooves 1000 may define a first plurality of projections (e.g., shown as projections 1041, 1042, and 1043) and a second plurality of projections (e.g., shown as projections 1051, 1052, and 1053). Each projection (e.g., projection 1041) of the first plurality of projections may be disposed inward of the perimeter groove 1010 and may correspond to a raised structure occupying an intersectional space between two adjacent grooves (e.g., grooves 1021 and 1022) of the first plurality of grooves and two adjacent grooves (e.g., grooves 1031 and 1032) of the second plurality of grooves. In other words, each projection of the first plurality of projections may be bounded by two adjacent grooves of the first plurality of grooves and two adjacent grooves of the second plurality of grooves intersecting the two adjacent grooves of the first plurality of grooves. In one example, each projection of the first plurality of projections may have a frusto-pyramidal shape with a flat peak surface for striking a golf ball. Each projection (e.g., projection 1051) of the second plurality of projections may be disposed adjacent the perimeter groove 1010 and may correspond to a raised structure occupying an intersectional space between the perimeter groove 1010, at least one groove (e.g., groove 1023) of the first plurality of grooves, and at least one groove (e.g., groove 1031) of the second plurality of grooves. In other words, each projection of the second plurality of projections may be bounded by the perimeter groove 1010, at least one groove of the first plurality of grooves, and at least one groove of the second plurality of grooves intersecting the at least one groove of the first plurality of grooves. Each projection of the second plurality of projections may have a variety of shapes based on the intersectional relationship between the perimeter groove 1010, the first plurality of grooves, and the second plurality of grooves. In one example, each projection of the second plurality of projections may correspond to a partial segment of a projection of the first plurality of projections. While the examples and figures described herein may describe and depict a face portion having particular projections, the apparatus, methods, and articles of manufacture described herein may include projections of other suitable shapes, size, position, etc. For example, the face portion 145 may include at two projections with different shape or size. Alternatively, the face portion 145 may not include a projection. In one example, the face portion 145 may include one or more horizontal grooves extending between the toe portion 120 and the heel portion 130. In another one example, the face portion 145 may include a smooth flat surface or a smooth contoured surface. The apparatus, methods, and articles of manufacture described herein are not limited in this regard.

Figure 11:
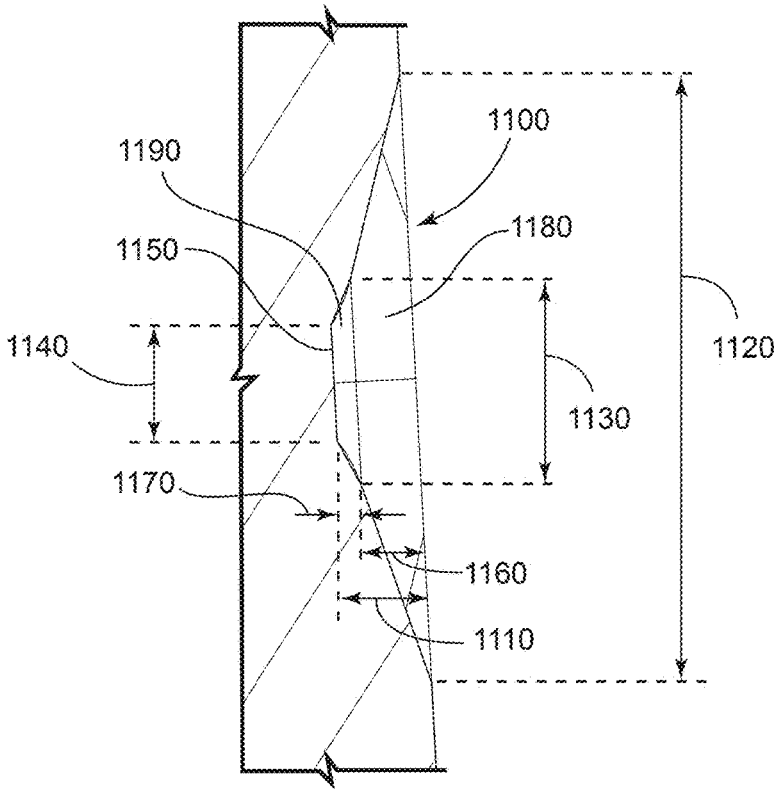
FIG. 11 depicts a schematic cross-sectional view of a representative groove of the face portion of FIG. 10 according to an embodiment of the apparatus, methods, and articles of manufacture described herein.

The first plurality of grooves and the second plurality of grooves may have similar groove properties (e.g., width and depth) and may be evenly spaced apart such that the first plurality of projections are the same size and shape. For purposes of understanding, an example groove 1100 is shown in FIG. 11 and may be representative of any groove of the first plurality of grooves and the second plurality of grooves. In the present example, the groove 1100 may have a depth 1110 greater than or equal to 0.010 inch (0.254 mm) and less than or equal to 0.015 inch (0.381 mm). The groove 1100 may have a variable width that decreases at a first rate from an upper width 1120 at the top of the groove 1100 to an intermediate width 1130 and decreases at a second rate from the intermediate width 1130 to a lower width 1140 at a base 1150 of the groove 1100. In one example, the upper width 1120 may be greater than or equal to 0.045 inch (1.143 mm) and less than or equal to 0.060 inch (1.524 mm), the intermediate width 1130 may be greater than or equal to 0.015 inch (0.381 mm) and less than or equal to 0.020 inch (0.508 mm), and the lower width may be greater than or equal to 0.009 inch (0.2286 mm) and less than or equal to 0.012 inch (0.3048 mm). Additionally, a rate of decrease from the upper width 1120 to the intermediate width 1130 may occur linearly over a depth 1160 greater than or equal to 0.007 inch (0.1778 mm) and less than or equal to 0.010 inch (0.254 mm) and a rate of decrease from the intermediate width 1130 to the lower width 1140 may occur non-linearly over a depth 1170 greater than or equal 0.003 inch (0.0762 mm) and less than or equal to 0.005 inch (0.127 mm). In the example of FIG. 11, the groove 1100 may be characterized as having an upper cross-section 1180 with an inverted frustoconical shape and a lower cross-section 1190 with an inverted truncated funnel shape. The apparatus, methods, and articles of manufacture described herein are not limited in this regard.

Figure 12:
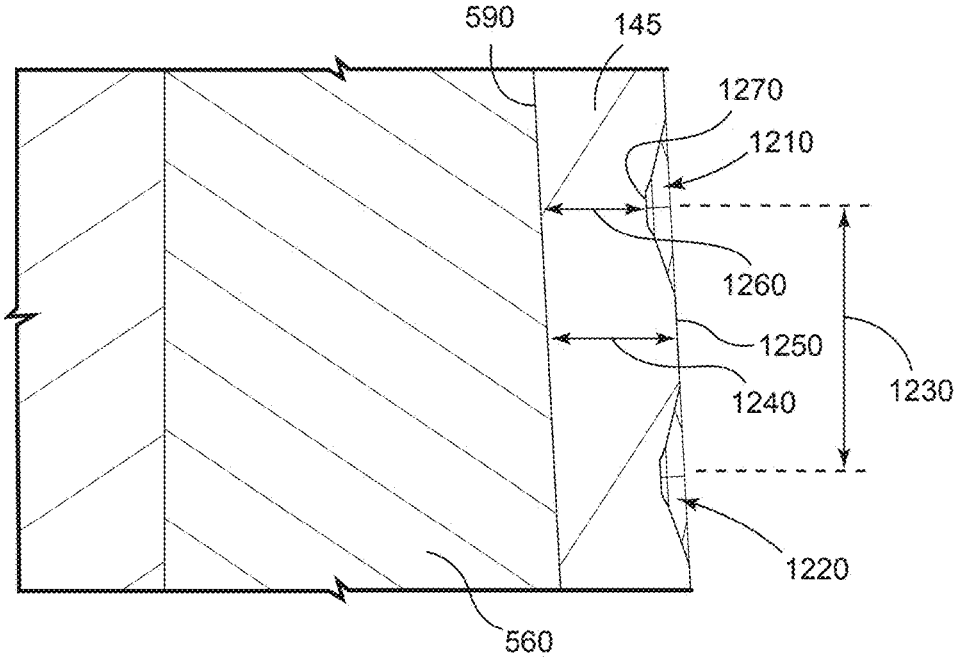
FIG. 12 depicts a schematic cross-sectional view of two representative grooves of the face portion of FIG. 10 according to an embodiment of the apparatus, methods, and articles of manufacture described herein.

Referring to FIG. 12, two adjacent grooves are shown as grooves 1210 and 1220 and may be representative of any two adjacent grooves of the first plurality of grooves or any two adjacent grooves of the second plurality of grooves. In the present example, a centerline spacing 1230 between grooves 1210 and 1220 may be greater than or equal to 0.060 inch (1.524 mm) and less than or equal to 0.100 inch (2.54 mm). In the present example, the face portion 145 may have a first face thickness 1240 greater than or equal to 0.035 inch (0.889 mm) and less than or equal to 0.055 inch (1.397 mm). The first face thickness 1240 may correspond to a distance between the rear surface 590 of the face portion 145 and a strike surface 1250 of the face portion 145, which may include the flat peak surfaces of the first plurality of projections. In one example, the flat peak surfaces of the first plurality of projections may be coplanar. The face portion 145 may also have a second face thickness 1260 greater than or equal to 0.035 inch (0.889 mm) and less than or equal to 0.045 inch (1.143 mm). The second face thickness 1260 may correspond to a distance between the rear surface 590 of the face portion 145 and a base (e.g., shown as base 1270) of a groove (e.g., groove 1210). In one example, the bases of the first plurality of grooves and the second plurality of grooves may be coplanar. The face portion 145 incorporating the plurality of grooves 1000 described herein may cooperate with the filler material 560 to provide enhanced performance properties such as consistent roll distance and improved feel and sound. The configurations and properties of the face portion and the plurality of grooves may be similar in many respects to the face portion and the plurality of the grooves described in U.S. Pat. Nos. 10,737,153 and 10,981,038, which are incorporated by reference herein. The apparatus, methods, and articles of manufacture described herein are not limited in this regard.

The mass properties of the golf club head 100 may be adjusted using a weighting system that may utilize a plurality of weight ports (e.g., toe-side weight port 220 and heel-side weight port 230) and corresponding interchangeable weight portions (e.g., weight portions 240 and 250). In one example, weight portions 240 and 250 may have the same mass and coupled the toe-side weight port 220 and the heel-side weight port 230, respectively, to provide balanced weighting to the golf club head 100. In another example, weight portion 240 may have a greater mass than weight portion 250, and weight portions 240 and 250 may be coupled the toe-side weight port 220 and the heel-side weight port 230, respectively, to counteract an individual's tendency to pull putts by restricting club head rotation and face closure during a putting stroke. In yet another example, weight portion 240 may have a lower mass than weight portion 250, and weight portions 240 and 250 may be coupled the toe-side weight port 220 and the heel-side weight port 230, respectively, to counteract an individual's tendency to push putts by promoting club head rotation and face closure during a putting stroke. The apparatus, methods, and articles of manufacture described herein are not limited in this regard.

Figure 13:
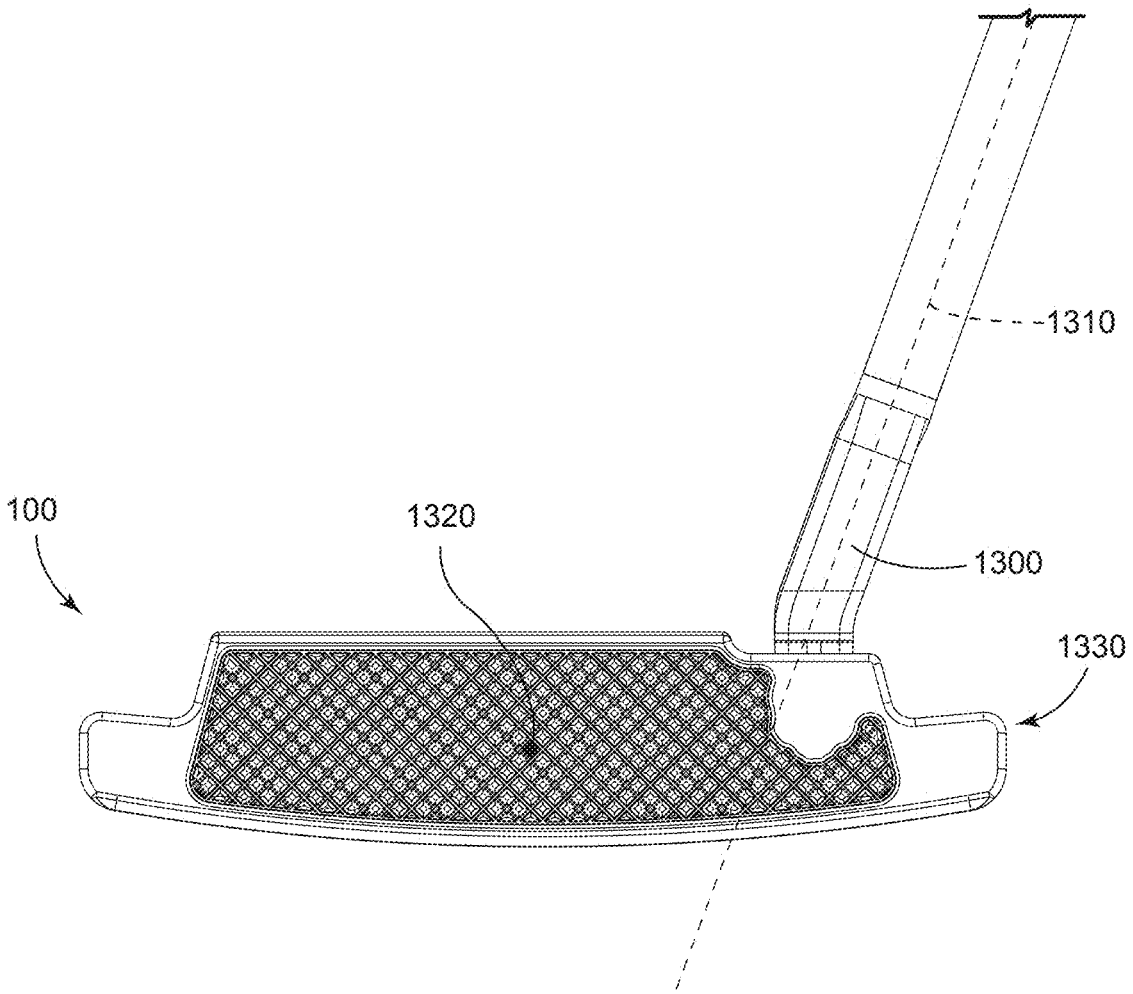
FIGS. 13, 14, and 15 depict a front elevational view of the golf club head of FIGS. 1-9 assembled to a heel-shafted hosel type, a double bend hosel type, and a plumber's neck hosel type, respectively, according to an embodiment of the apparatus, methods, and articles of manufacture described herein.
Figure 14:
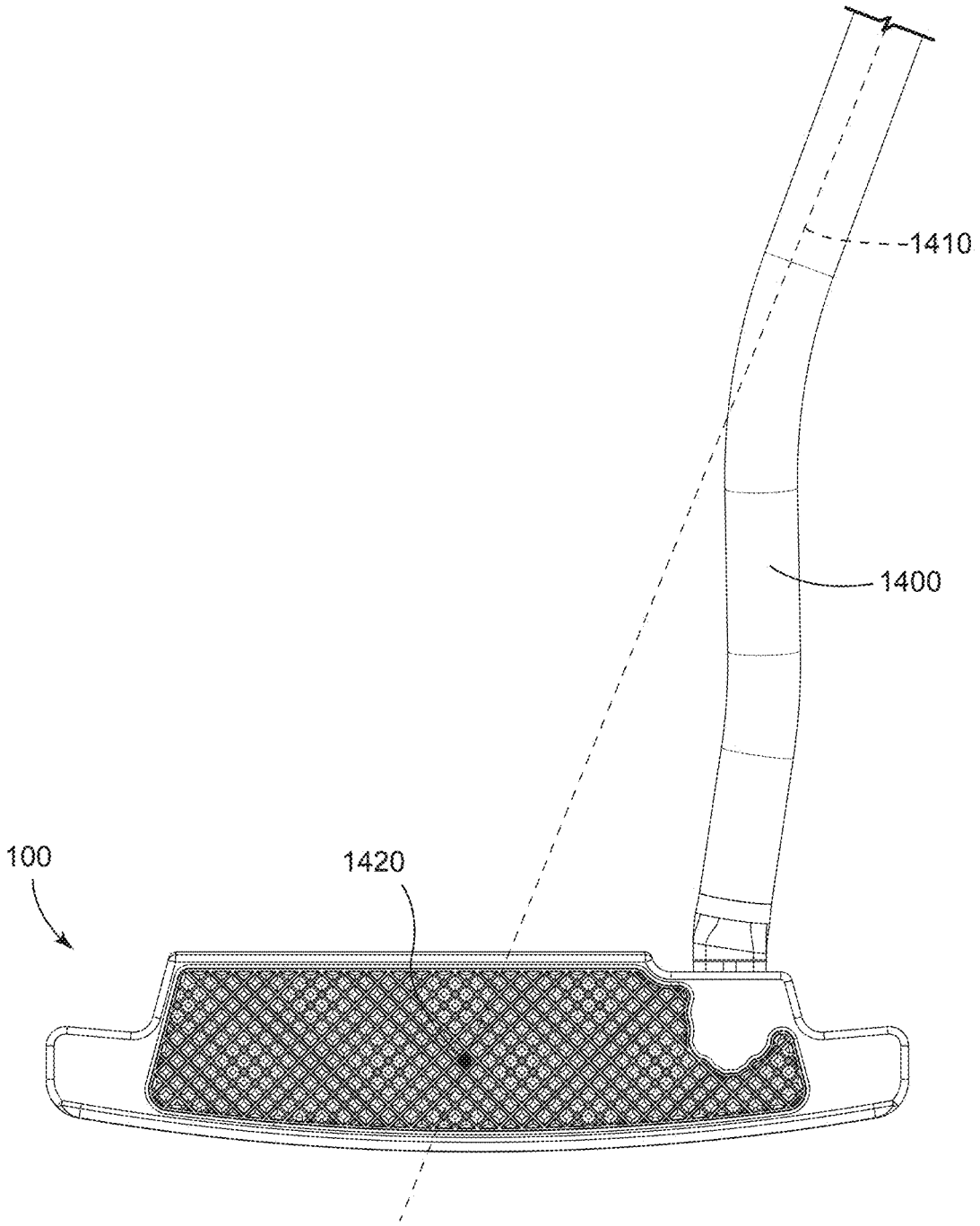
Figure 15:
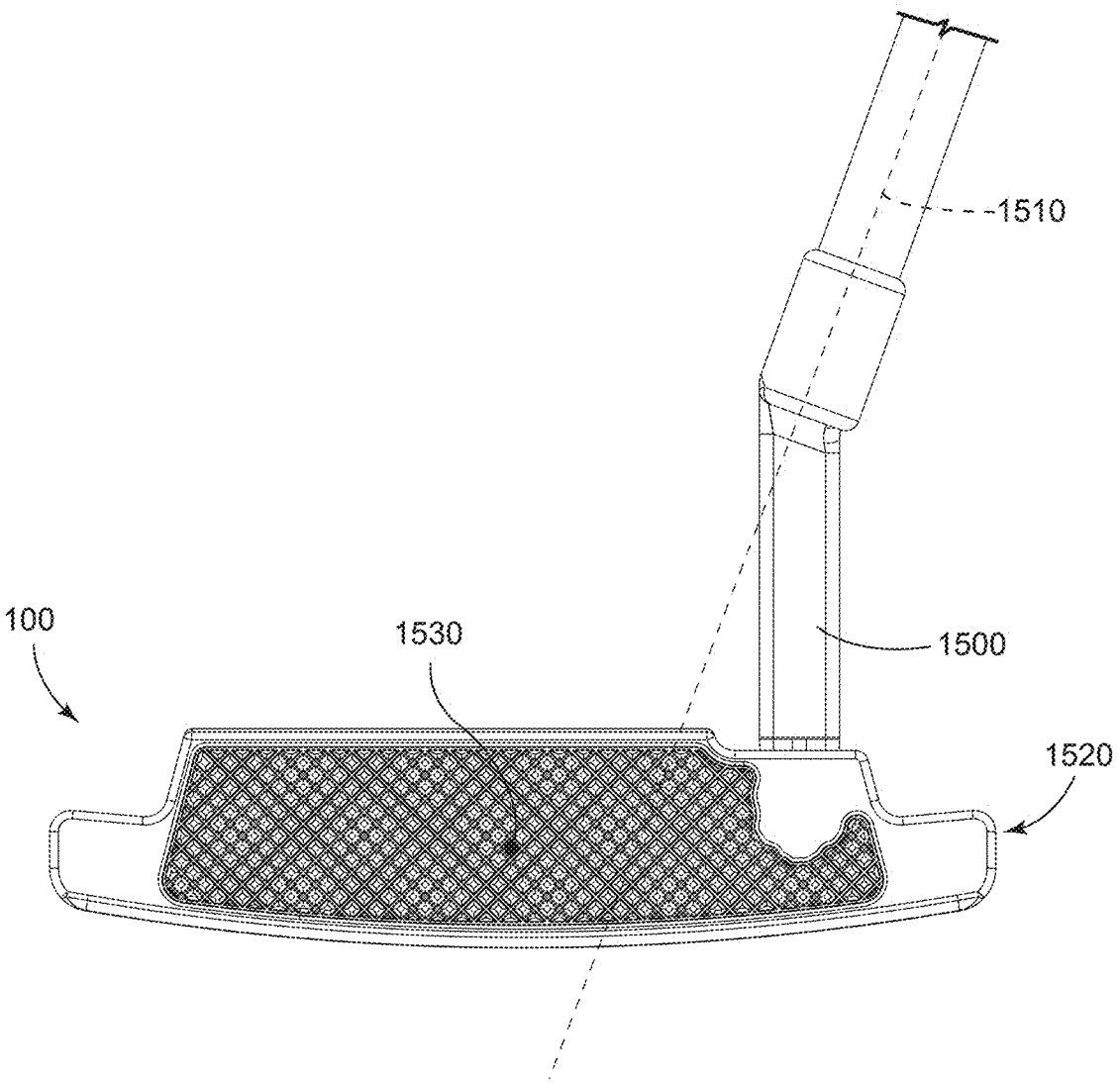
Figure 16:
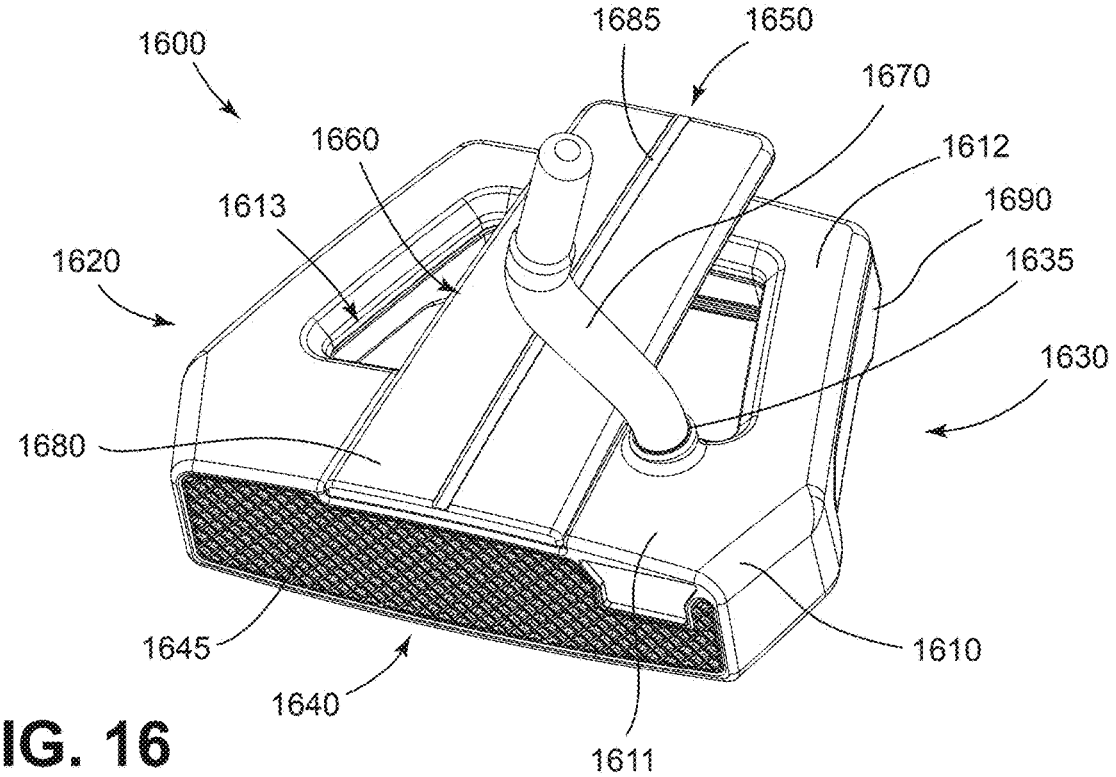
FIGS. 16, 17, 18, 19, 20, 21, 22, 23, 24, 25, 26, and 27 depict a perspective front view, a perspective rear view, a front elevational view, a rear elevational view, a top view, a bottom view, a left view, a right view, an exploded top perspective view, an exploded bottom perspective view, a perspective cross-sectional view (along line 26-26 of FIG. 18), and a perspective cross-sectional view (along line 27-27 of FIG. 18), respectively, of a golf club head according to an embodiment of the apparatus, methods, and articles of manufacture described herein.
Figure 17:
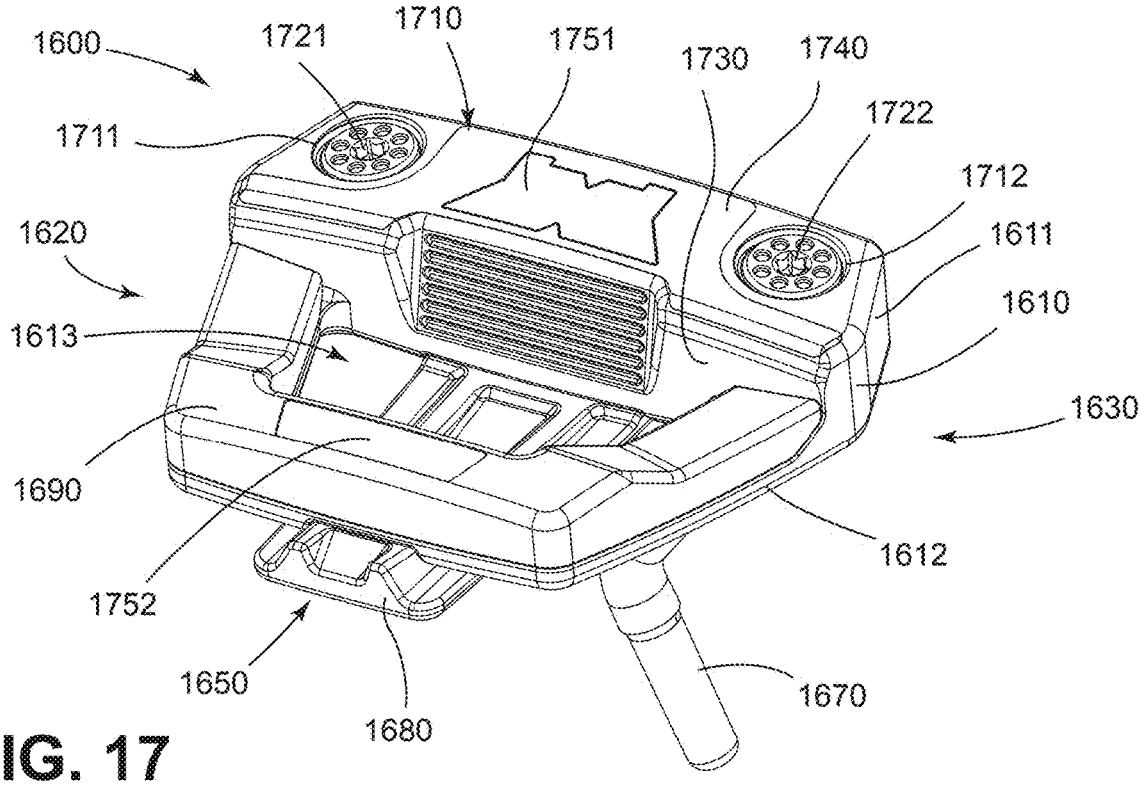
Figure 18:
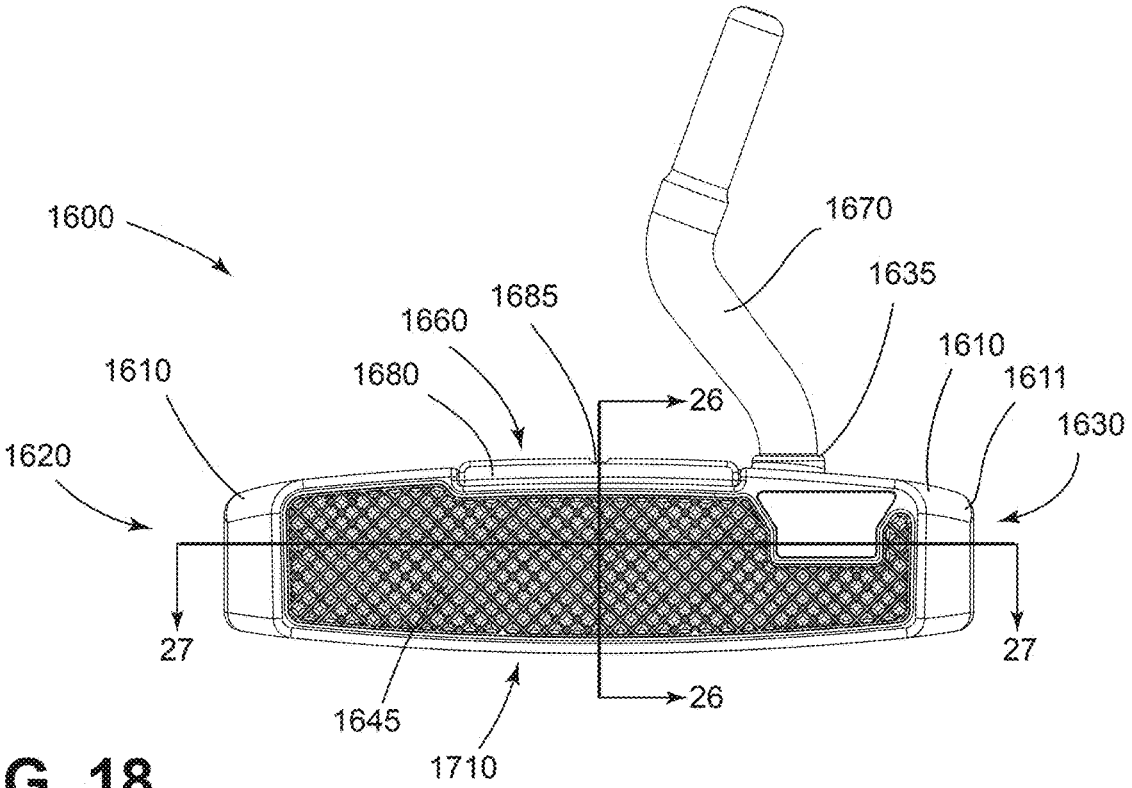
Figure 19:
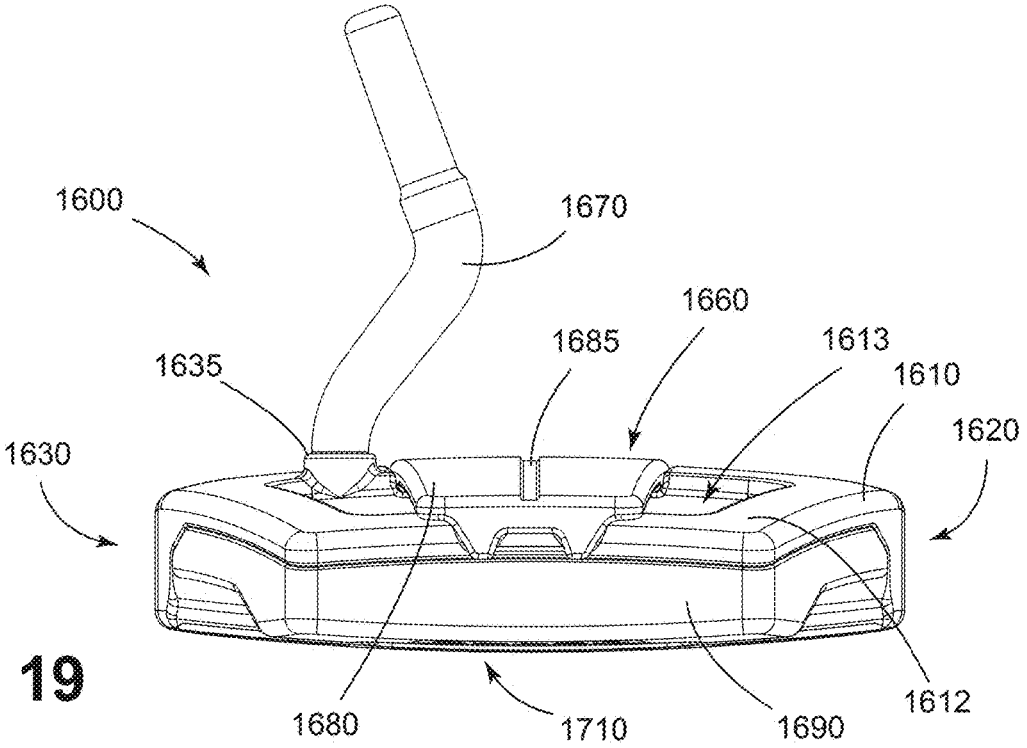

The mass properties of the golf club head 100 may be further adjusted with an interchangeable hosel system that may utilize a hosel bore instead of a fixed hosel (e.g., an integral portion of the body portion 110). Accordingly, the hosel bore 135 may be configured to receive a variety of hosel types to adjust the balance of the golf club head 100. In one example, as shown in FIG. 13, a hosel portion 1300 configured as a heel-shafted hosel type may be coupled to the hosel bore 135 to orient a shaft axis 1310 away from a CG location 1320 and more toward a heel portion 1330 of the golf club head 100 to increase the inertial force required to rotate the golf club head 100 during a putting stroke. A heel-shafted hosel may produce a large degree of toe hang (e.g., greater than 45 degrees) and may be preferred by individuals that tend to over-rotate the golf club head 100, thereby producing a closed face at impact. In another example, as shown in FIG. 14, a hosel portion 1400 configured as a double bend hosel type may be coupled to the hosel bore 135 to orient a shaft axis 1410 through a CG location 1420 to moderately reduce the inertial force required to rotate the golf club head 100 during a putting stroke. Alternatively, an armlock hosel type (not shown) may be used to accomplish the same. A double bend hosel type or armlock hosel type may promote face balancing and may be preferred by individuals that tend to under-rotate the golf club head 100 thereby producing an open face at impact. In yet another example, as shown in FIG. 15, a hosel portion 1500 configured as a plumber's neck hosel type may be coupled to the golf club head 100 to orient a shaft axis 1510 away from a heel portion 1520 and closer to a CG location 1530 of the golf club head 100 to significantly reduce the inertial force required to rotate the golf club head 100 during a putting stroke. A plumber's neck hosel type may produce a moderate degree of toe hang (e.g., less than or equal to 45 degrees) and may be preferred by individuals exhibiting mild levels of club head rotation. By employing one or both of the weighting system and the interchangeable hosel system described herein, the mass properties of the golf club head 100 may be adjusted to fit the needs of any individual regardless of putting style or swing tendencies while providing greater forgiveness due to the golf club head 100 benefitting from higher MOI compared to conventional solid-body golf club heads. While the examples and figures may describe and depict a hosel bore and a separate hosel portion, the apparatus, methods, and articles of manufacture described herein may include a hosel portion integral to the body portion. The apparatus, methods, and articles of manufacture described herein are not limited in this regard.

In the example of FIGS. 16-30, a golf club head 1600 is generally shown as a mid-mallet or mallet type putter. The golf club head 1600 may include a body portion 1610 having a toe portion 1620, a heel portion 1630, a hosel bore 1635, a front portion 1640, a face portion 1645, a rear portion 1650, a top portion 1660, and a sole portion 1710. The body portion 1610 may be made from any of the materials described herein or described in any of the incorporated by reference patent documents. The face portion 1645 may be located at the front portion 1640 and may define a front surface of the body portion 1610 for striking a golf ball (e.g., shown as golf ball 2900). The face portion 1645 may be generally planar and may have a loft angle that is greater than or equal to two degrees and less than or equal to four degrees. The sole portion 1710 may include a plurality of weight ports (e.g., shown as a toe-side weight port 1711 and a heel-side weight port 1712) each configured to receive a complementary weight portion (e.g., shown as weight portions 1721 and 1722). Weight portions 1721 and 1722 may be configured as interchangeable screws threadedly coupled to the toe-side weight port 1711 and the heel-side weight port 1712, respectively. Weight portions 1721 and 1722 may have similar or different material compositions and/or physical properties (e.g., density, color, texture) with respect to each other and the body portion 1610. The configuration and/or properties of each of the weight ports and the weight portions may be similar in many respects to any of the weight ports and weight portions described herein or described in any of the incorporated by reference patent documents. The hosel bore 1635 may be located at or proximate the heel portion 1630 and may be configured to receive a hosel portion 1670. The hosel portion 1670 may have similar or different material compositions and/or physical properties with respect to the body portion 1610. The hosel portion 1670 may be made from any of the materials described herein or described in any of the incorporated by reference patent documents. The apparatus, methods, and articles of manufacture described herein are not limited in this regard.

In one example, the body portion 1610 may be defined by a forward portion 1611 and an aft portion 1612 extending rearward from the forward portion 1611. The forward portion 1611 may extend from the face portion 1645 to a back wall portion 1730 opposite to the face portion 1645. The back wall portion 1730 may extend between the toe portion 1620 and the heel portion 1630 and may be located between the front portion 1640 and the rear portion 1650. The aft portion 1612 may extend rearward from the back wall portion 1730 and may include the rear portion 1650. In one example, the aft portion 1612 may be cantilevered from the forward portion 1611. Collectively, the forward portion 1611 and the aft portion 1612 may partially enclose a central void space 1613 of the body portion 1610. In one example, the central void space 1613 may extend in a top-to-sole direction. In another example, the central void space 1613 may extend in a toe-to-heel direction. The body portion 1610 may include an interior cavity 2500 that interfaces with an opening 2510 located at the sole portion 1710. The interior cavity 2500 may be provided within the forward portion 1611 and may extend between the face portion 1645 and the back wall portion 1730. The interior cavity 2500 may also extend between the top portion 1660 and the sole portion 1710 and between the toe portion 1620 and the heel portion 1630. A sole plate 1740 may be coupled to the body portion 1610 to close the opening 2510. The sole plate 1740 may have similar or different material compositions and/or physical properties as the body portion 1610. The sole plate 1740 may include any of the materials described herein or described in any of the incorporated by reference patent documents. In one example, the sole plate 1740 may be made from a material having a density that is less than a density of the body portion 1610 to enable greater discretionary mass placement in other regions of the golf club head 1600. The sole plate 1740 may be welded to the body portion 1610 or otherwise attached to the body portion 1610 using adhesive and/or mechanical fasteners. The apparatus, methods, and articles of manufacture described herein are not limited in this regard.

A central portion 1680 may be coupled to the body portion 1610 and may be configured to extend across the central void space 1613 in a front-to-rear direction. The central portion 1680 may be located at the top portion 1660 and may bridge the front portion 1640 and the rear portion 1650. In one example, the central portion 1680 may extend farther rearward than the rearmost extent of the aft portion 1612. The central portion 1680 may include any type of alignment aid. In one example, as illustrated in FIGS. 16-30, an alignment aid 1685 is generally shown as a line extending longitudinally across the central portion 1680 to assist an individual with addressing the golf club head 100 to the golf ball 2900. The central portion 1680 may have similar or different material compositions and/or physical properties as the body portion 1610. The central portion 1680 may include any of the materials described herein or described in any of the incorporated by reference patent documents. In one example, the central portion 1680 may be made from a material having a density that is less than a density of the body portion 1610 to enable greater discretionary mass placement in other regions of the golf club head 1600. Accordingly, the central portion 1680 may be provided as a separate piece attached to the body portion 1610. In another example, the central portion 1680 may be co-manufactured with the body portion 1610 so as to be a continuous one-piece part with the body portion 1610. In another example, all or portions of the central portion 1680 may have different surface visual effects such as surface texture, geometric shapes (e.g., a circle resembling a golf ball), alphanumeric information and/or one or more colors to further assist in the alignment aid functionality of the central portion 1680. The apparatus, methods, and articles of manufacture described herein are not limited in this regard.

A lower portion 1690 may be coupled to the body portion 1610 and may provide structural support to the aft portion 1612. The lower portion 1690 may undergird the aft portion 1612 and may be configured with a complementary shape to the aft portion 1612 so as not to obstruct the central void space 1613. The lower portion 1690 may have similar or different material compositions and/or physical properties as the body portion 1610. The lower portion 1690 may include any of the materials described herein or described in any of the incorporated by reference patent documents. In one example, the lower portion 1690 may be made from a material having a density that is less than a density of the body portion 1610 to enable greater discretionary mass placement in other regions of the golf club head 1600. To this end, the lower portion 1690 may be made from a lightweight material that is resistant to deformation (e.g., a composite material). Accordingly, the lower portion 1690 may be provided as a separate piece attached to the body portion 1610. In another example, the lower portion 1690 may be co-manufactured with the body portion 1610 so as to be a continuous one-piece part with the body portion 1610. In one example, the lower portion 1690 may cooperate with the back wall portion 1730 to frictionally engage a golf ball. Accordingly, the golf club head 1600 may be used to pick up a golf ball by positioning the central void space 1613 over the golf ball and pressing the golf club head 1600 onto the golf ball such that the golf ball becomes lodged or pinched between the lower portion 1690 and the back wall portion 1730. In one example, the ball engaging surfaces of the lower portion 1690 and the back wall portion 1730 may be textured to improve frictional engagement with the golf ball. The apparatus, methods, and articles of manufacture described herein are not limited in this regard.

In assembly, the central portion 1680 may include a front end portion 2411 and a rear end portion 2412, each of which may be at least partially received in a complementary recess (e.g., shown as recess 2421 and recess 2422, respectively) at the top of the forward portion 1611 and at the top and rear of the aft portion 1612, respectively. The front end portion 2411 may include a boss 2520 received in a complementary indent 2430 in recess 2421 to properly position the central portion 1680 atop the body portion 1610. The boss 2520 may include a fastener port 2521 aligned with an opening 2431 extending through indent 2430 and interfacing with the interior cavity 2500. The fastener port 2521 and opening 2431 may be aligned with a through-port 2440 connected to a depression 2530 in an outer surface 2540 of the sole plate 1740. A mechanical fastener 2451 may be inserted into the through-port 2440 and threadedly engaged to fastener port 2521 via opening 2431 thereby joining the front end portion 2411 to the body portion 1610 and the sole plate 1740. The rear end portion 2412 may include a fastener port 2522 aligned with an opening 2432 in recess 2422 and a through-port 2461 connected to a depression 2550 in a lower outer surface 2560 of the lower portion 1690. A mechanical fastener 2452 may be inserted into the through-port 2461 and threadedly engaged to fastener port 2522 via opening 2432 thereby joining the rear end portion 2412 to the body portion 1610 and the lower portion 1690. In addition to mechanical fastener 2452, the lower portion 1690 may be attached to the underside of the aft portion 1612 using an adhesive. A complementary cover portion (e.g., shown as cover portions 1751 and 1752) may be received in each of depressions 2530 and 2550 to conceal corresponding mechanical fasteners 2451 and 2452, respectively. In one embodiment, cover portions 1751 and 1752 may each be configured as decorative badges and may be attached to corresponding depressions 2530 and 2550 using adhesive. The apparatus, methods, and articles of manufacture described herein are not limited in this regard.

The interior cavity 2500 may be partially or entirely filled with a filler material 2470. The filler material 2470 may include any of the filler materials described herein or described in any of the incorporated by reference patent documents. In one example, the filler material 2470 may include a low-density polymer material. In another example, the filler material 2470 may be a solid piece manufactured in the shape of the interior cavity 2500 so as to be insertable into the interior cavity 2500 through the opening 2510. In yet another example, the filler material 2470 may be an injectable liquid or fluid material provided to the interior cavity 2500 via one or more openings (e.g., opening 2510) and later hardened at ambient conditions or during a curing process. The filler material 2470 may be disposed within the interior cavity 2500 to contact and reinforce a rear surface 2570 of the face portion 1645 to reduce face deformation and also dampen sound and vibration. Additionally, the filler material 2470 may at least partially encase the depression 2530 and the through-port 2440 of the sole plate 1740. The filler material 2470 may provide structural support to the cavity walls and/or the face portion 1645 of the golf club head 1600. Accordingly, the cavity walls may be relatively thin to accommodate a greater amount of the filler material

2470 in the interior cavity 2500 and to provide increased discretionary mass, and the face portion 1645 may be relatively thin to provide a greater flexibility or rebounding effect. In one example, one or more cavity walls may have a thickness (constant or average) greater than or equal to 0.035 inch (0.889 mm) and less than or equal to 0.060 inch (1.524 mm). In another example, the face portion 1645 may have a face thickness 2600 in one or more areas greater than or equal to 0.035 inch (0.889 mm) and less than or equal to 0.055 inch (1.397 mm) (e.g., first face thickness 1240) and greater than or equal to 0.035 inch (0.889 mm) and less than or equal to 0.045 inch (1.143 mm) (e.g., second face thickness 1260) as described herein with reference to FIG. 12. In another example, the face portion 1645 may have a face thickness 2600 in one or more areas less than or equal to 0.035 inch (0.889 mm) or greater than or equal to 0.055 inch (1.397 mm). The face portion 1645 including the face thickness at one or more area on the face portion 1645 may be similar in many respects to any face portion (e.g., face portion 145) described herein or described in any of the incorporated by reference patent documents. The apparatus, methods, and articles of manufacture described herein are not limited in this regard.

Figure 26:
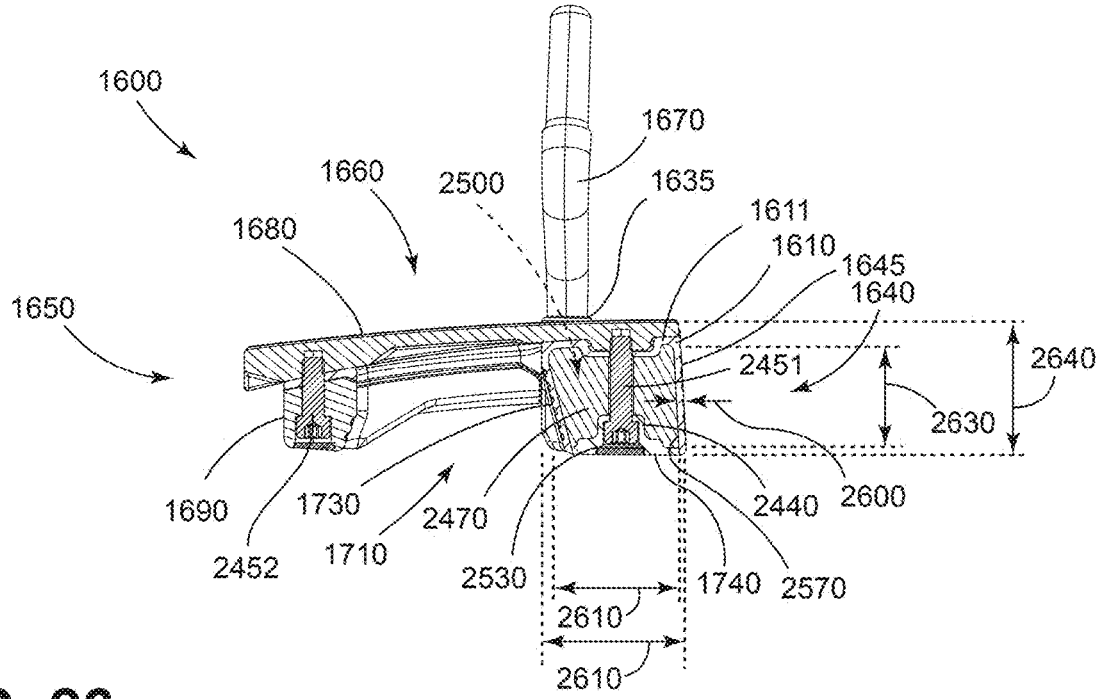
Figure 27:
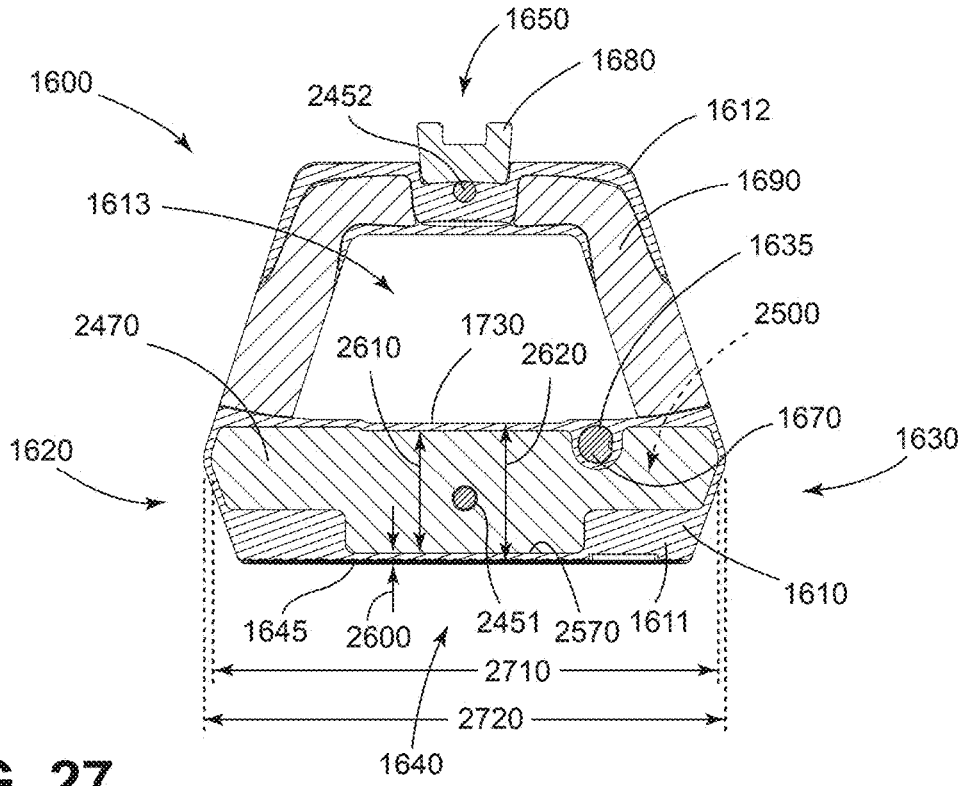

With reference to FIGS. 26 and 27. In one example, the golf club head 1600 may have at least one cross-section where the filler material 2470 has a length 2610 in a front-to-rear direction greater than or equal to 80% of a length 2620 between the face portion 1645 and the back wall portion 1730 in the front-to-rear direction. In another example, the golf club head 1600 may have at least one cross-section where the filler material 2470 has a length 2610 in a front-to-rear direction greater than or equal to 65% of a length 2620 between the face portion 1645 and the back wall portion 1730 in the front-to-rear direction. With reference to FIG. 26, in one example, the golf club head 1600 may have at least one cross-section where the filler material 2470 may have a length 2630 in a top-to-sole direction greater than or equal to 70% of a length 2640 of the body portion 1610 in the top-to-sole direction. In another example, the golf club head 1600 may have at least one cross-section where the filler material 2470 may have a length 2630 in a top-to-sole direction greater than or equal to 55% of a length 2640 of the body portion 1610 in the top-to-sole direction. With reference to FIG. 27, in one example, the golf club head 1600 may have at least one cross-section wherein the filler material 2470 has a length 2710 in a toe-to-heel direction greater than or equal to 90% of a length 2720 of the body portion 1610 in the toe-to-heel direction. In another example, the golf club head 1600 may have at least one cross-section wherein the filler material 2470 has a length 2710 in a toe-to-heel direction greater than or equal to 75% of a length 2720 of the body portion 1610 in the toe-to-heel direction. The apparatus, methods, and articles of manufacture described herein are not limited in this regard.

The filler material 2470 may have a density less than a density of the body portion 1610 to allow for more discretionary mass to be allocated to other areas of the golf club head 1600. With respect to the present example, the filler material 2470 may have a fill volume ($V_f$) greater than or equal to 30% and less than or equal to 40% of a total volume ($V_t$) of the golf club head 1600 (e.g., with or without the hosel portion 1670) and a fill mass ($M_f$) greater than or equal to 5% and less than or equal to 10% of a total mass ($M_t$) of the golf club head 1600 (e.g., with or without the hosel portion 1670). In one example, the total volume ($V_t$) of the golf club head 1600 may be greater than or equal to 5.40 inch$^3$ (88.490 cm$^3$) and less than or equal to 5.90 inch$^3$ (96.684 cm$^3$) and the total mass ($M_t$) of the golf club head 1600 may be greater than or equal to 320 grams and less than or equal to 370 grams. As described herein, selecting the filler material 2470 from a lightweight or low-density material and increasing the fill volume ($V_f$) of the filler material 2470 relative to the total volume ($V_t$) of the golf club head 1600 may enable greater discretionary mass placement toward a periphery of the golf club head 1600 to optimize certain mass properties of the golf club head 1600 such as MOI, CG location, and mass balance while maintaining a suitable club head weight. In one example, a ratio between a percentage fill volume $$\left(\frac{Vf}{Vt}\times 100\right)$$

and a percentage fill mass $$\left(\frac{Mf}{Mt}\times 100\right)$$

of the filler material 2470 may be greater than or equal to 3.00 and the golf club head 1600 may have a MOI greater than or equal to 4000 g·cm$^2$. In another example, the golf club head 1600 may have a MOI greater than or equal to 4250 g·cm$^2$. In yet another example, the golf club head 1600 may have a MOI greater than or equal to 4500 g·cm$^2$. The apparatus, methods, and articles of manufacture described herein are not limited in this regard.

As described herein, the golf club head 1600 may include a weighting system that may utilize a plurality of weight ports (e.g., toe-side weight port 1711 and heel-side weight port 1712) and corresponding interchangeable weight portions (e.g., weight portions 1721 and 1722) to adjust the mass properties of the golf club head 1600. Additionally, as described herein, the hosel bore 1635 may be configured to receive any of the hosel types described herein or described in any of the incorporated by reference patent documents to further adjust the mass properties of the golf club head 1600. The apparatus, methods, and articles of manufacture described herein are not limited in this regard.

Figure 20:
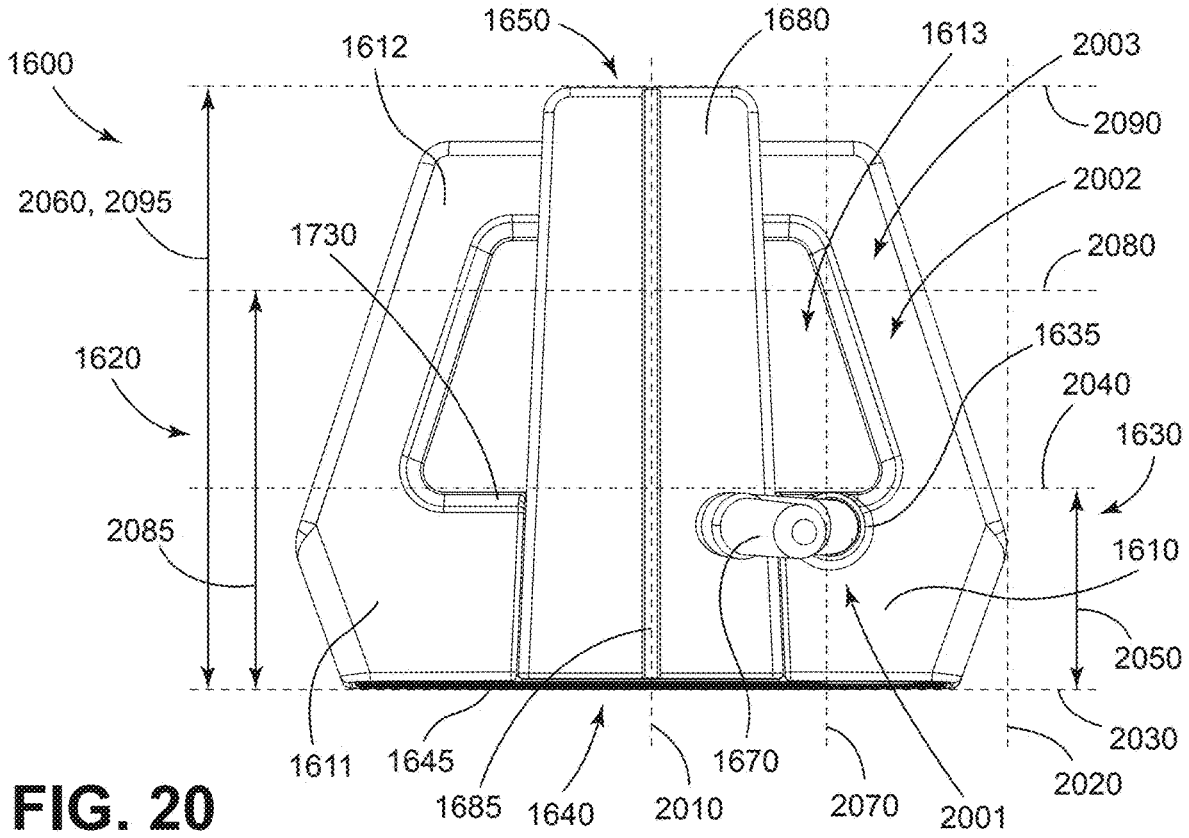
Figure 21:
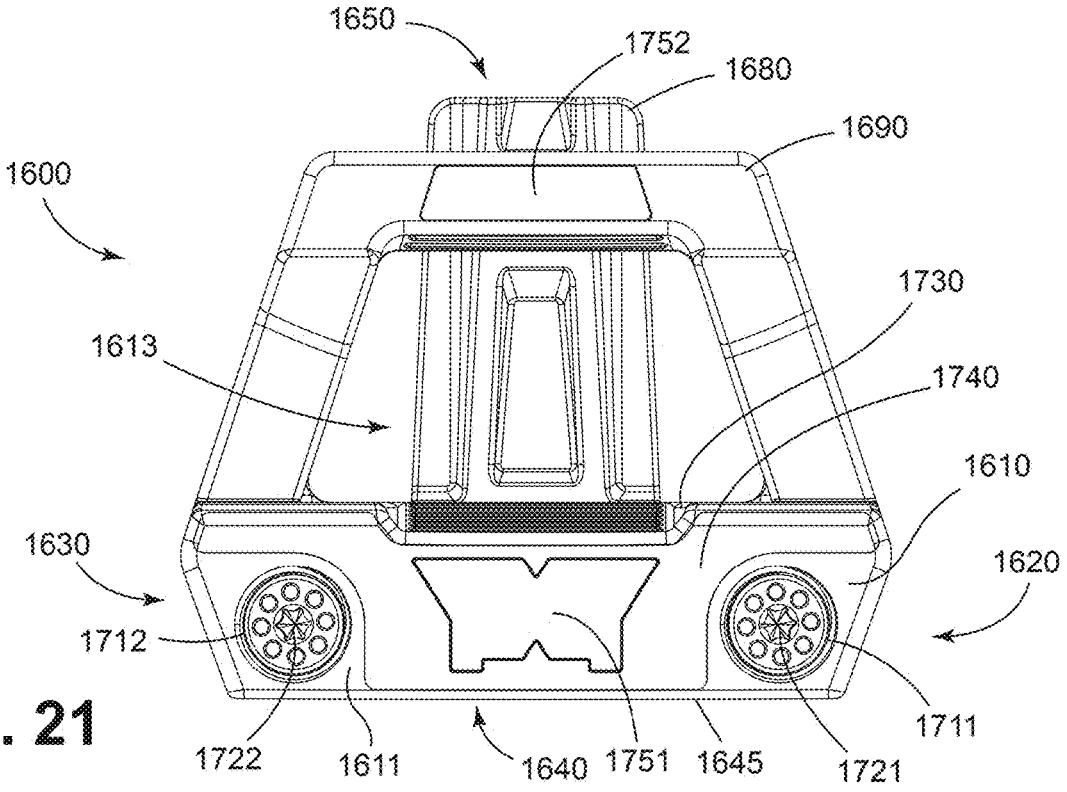
Figure 22:
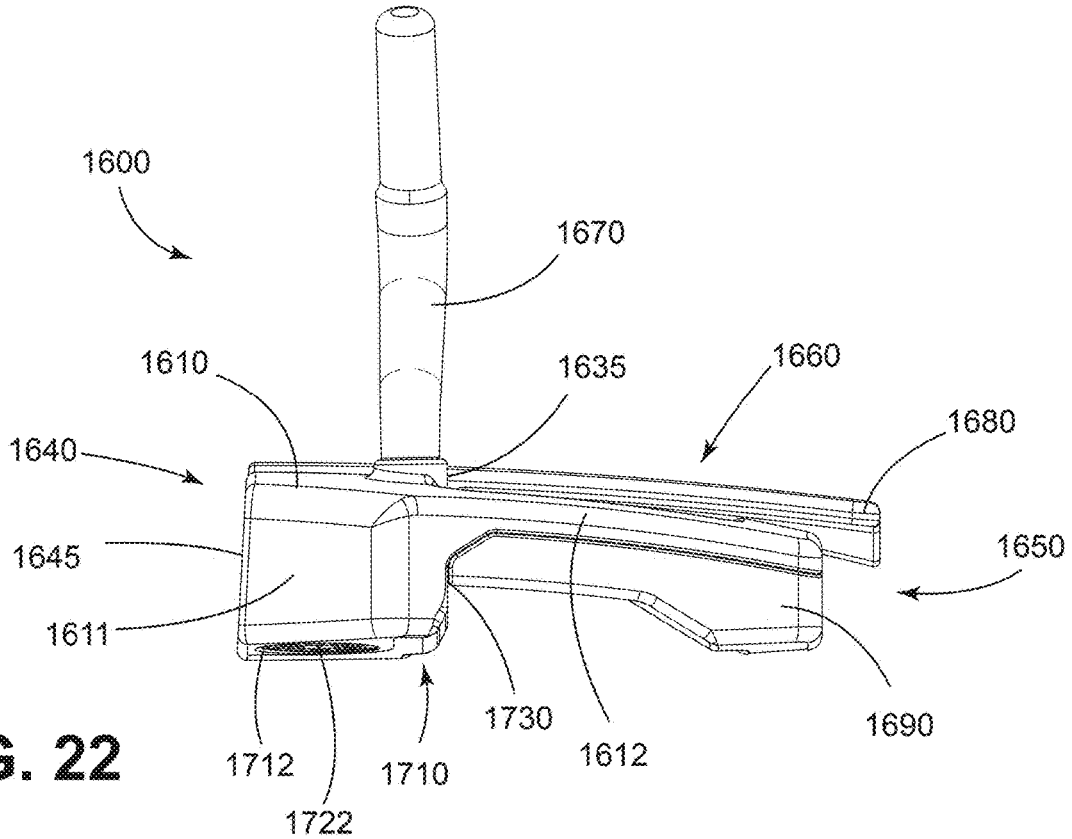
Figure 23:
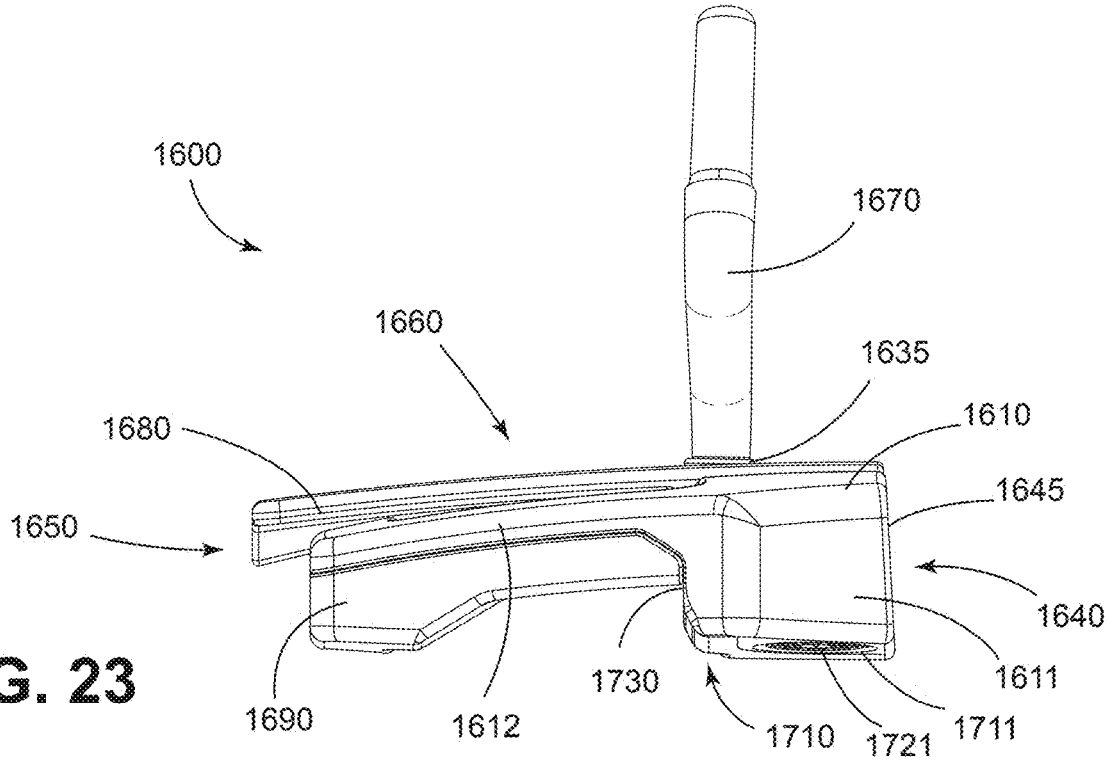
Figure 24:
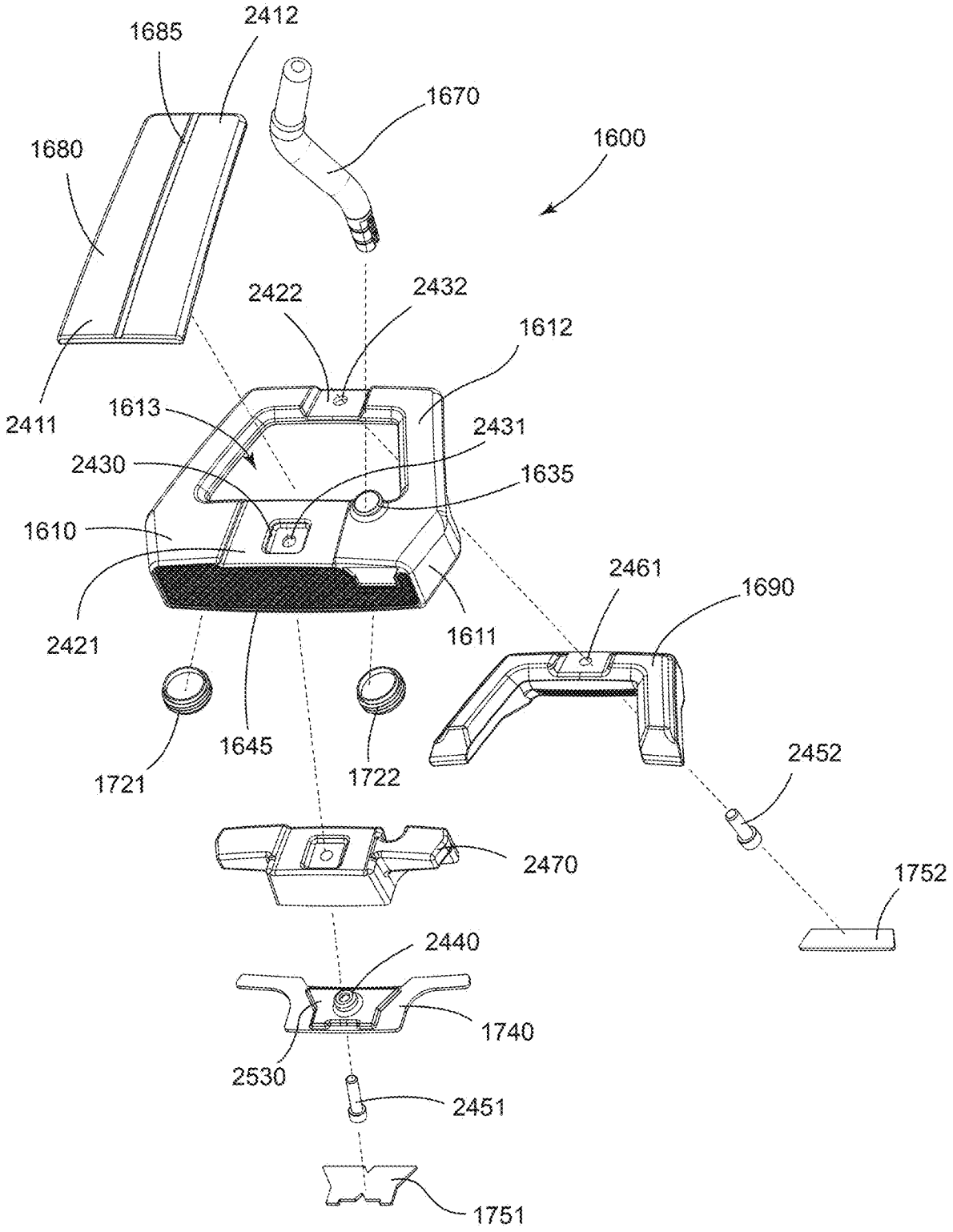
Figure 25:
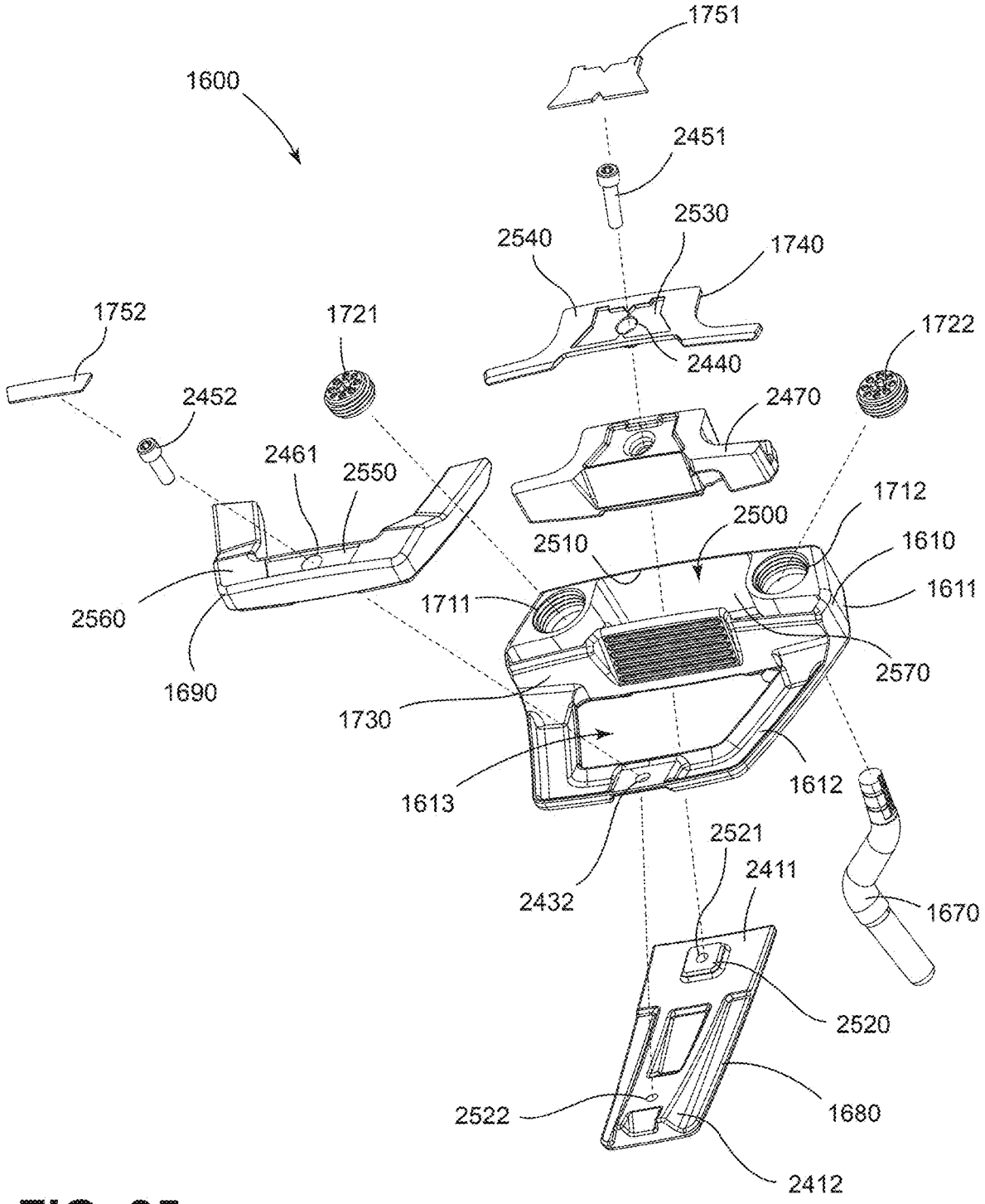
Figure 28:
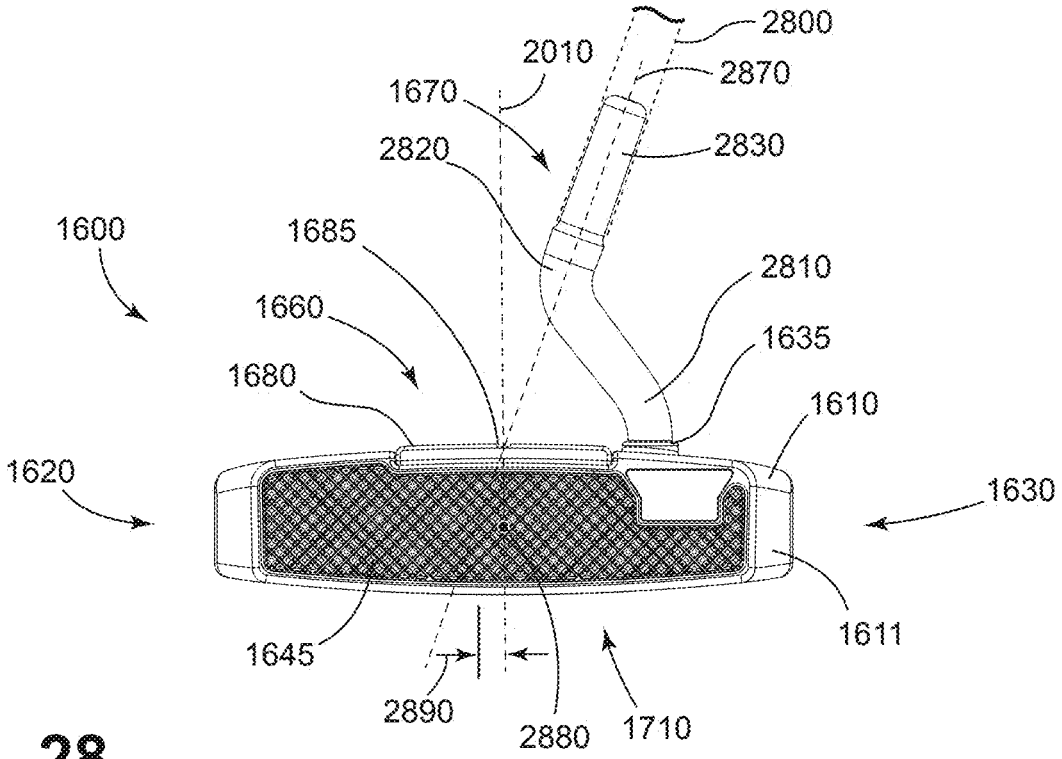
FIG. 28 depicts a shaft axis oriented toe-ward relative to a center of gravity of the golf club head of FIG. 16 according to an embodiment of the apparatus, methods, and articles of manufacture described herein.

With reference to FIG. 28, the hosel bore 1635 is shown coupled to the hosel portion 1670. The hosel portion 1670 may have a serpentine shape and may include a first bend portion 2810, a second bend portion 2820, and a tip portion 2830 configured to be received inside a golf shaft 2800. In one example, as shown in FIG. 20, the hosel bore 1635 and the hosel portion 1670 may be located at or proximate the heel portion 1630 and may be entirely disposed within a front space 2001 bounded by a center longitudinal plane 2010, a heel boundary plane 2020 parallel to the center longitudinal plane 2010, a front boundary plane 2030, and a first lateral plane 2040 parallel to the front boundary plane 2030 and separated from the front boundary plane 2030 by a distance 2050 equal to one third of a total length 2060 of the golf club head 1600 in the front-to-rear direction. The hosel bore 1635 and the hosel portion 1670 may be intersected by a heel dividing plane 2070 parallel to and equidistant from the center longitudinal plane 2010 and the heel boundary plane 2020. In another example, the hosel bore 1635 and the hosel portion 1670 may be partially or entirely disposed within a middle space 2002 bounded by the center longitudinal plane 2010, the heel boundary plane 2020, the first lateral plane 2040, and a second lateral plane 2080 parallel to the front boundary plane 2030 and separated from the front boundary plane 2030 by a distance 2085 equal to two thirds the total length 2060 of the golf club head 1600 in the front-to-rear direction. In yet another example, the hosel bore 1635 and the hosel portion 1670 may be partially or entirely disposed within a rear space 2003 bounded by the center longitudinal plane 2010, the heel boundary plane 2020, the second lateral plane 2080 and a third lateral plane 2090 parallel to the front boundary plane 2030 and separated from the front boundary plane 2030 by a distance 2095 equal to the total length 2060 of the golf club head 1600 in the front-to-rear direction. The apparatus, methods, and articles of manufacture described herein are not limited in this regard.

Figure 29:
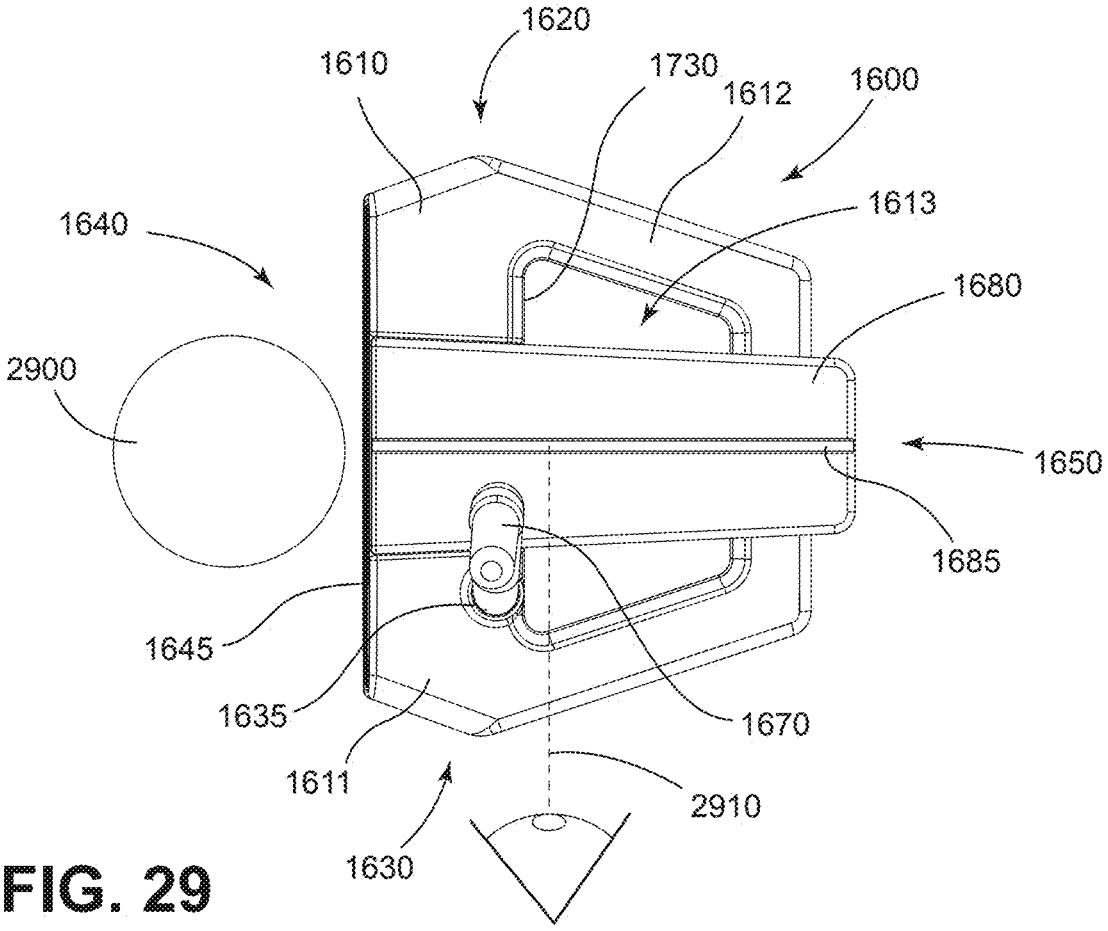
FIG. 29 depicts the golf club head of FIG. 16 at an address position to strike a golf ball according to an embodiment of the apparatus, methods, and articles of manufacture described herein.
Figure 30:
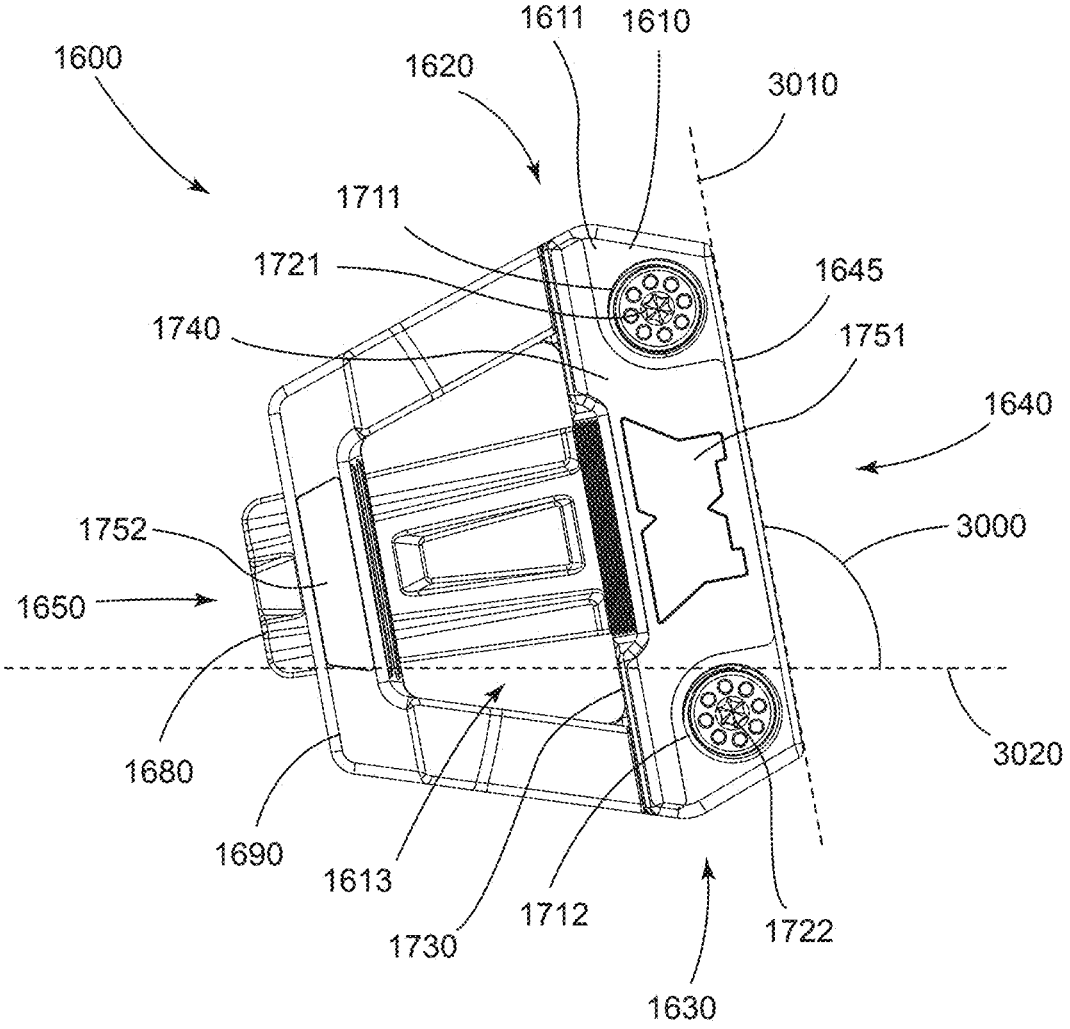
FIG. 30 depicts a hang angle of the golf club head of FIG. 16 according to an embodiment of the apparatus, methods, and articles of manufacture described herein.

Referring still to FIG. 28, the hosel portion 1670 may be configured to orient a shaft axis 2870 toe-ward relative to a CG location 2880 of the golf club head 1600. In other words, a distance between the shaft axis 2870 and the center longitudinal plane 2010 may increase in a heel-to-toe direction as the shaft axis 2870 extends from a location of intersection of the shaft axis 2870 and the center longitudinal plane 2010 toward the sole portion 1710. The shaft axis 2870 may intersect with the center longitudinal plane 2010 at or proximate (e.g., below) the alignment aid 1685 such that the hosel portion 1670 provides an unobstructed view 2910 of the alignment aid 1685 when the golf club head 1600 is addressed to the golf ball 2900 as shown in FIG. 29. In one example, a distance 2890 between the shaft axis 2870 and the CG location 2880 in the heel-to-toe direction may be greater than or equal to 3 mm and less than or equal to 10 mm toward the toe portion 1620. In another example, the distance 2890 between the shaft axis 2870 and the CG location 2880 may be greater than or equal to 4 mm and less than or equal to 8 mm toward the toe portion 1620. In yet another example, the distance 2890 between the shaft axis 2870 and the CG location 2880 may be greater than or equal to 5 mm and less than or equal to 6 mm toward the toe portion 1620. With respect to each of the foregoing examples, the shaft axis 2870 may have zero offset with the CG location 2880 in the front-to-rear direction or may be offset from the CG location 2880 toward the front portion 1640 or the rear portion 1650. In one example, the shaft axis 2870 and the CG location 2880 may be offset by a distance greater than or equal to 0 mm and less than or equal to 5 mm in the front-to-rear direction toward the front portion 1640 or the rear portion 1650. In another example, the shaft axis 2870 and the CG location 2880 may be offset by a distance greater than or equal to 0 mm and less than or equal to 4 mm in the front-to-rear direction toward the front portion 1640 or the rear portion 1650. In yet another example. the shaft axis 2870 and the CG location 2880 may be offset by a distance greater than or equal to 0 mm and less than or equal to 3 mm in the front-to-rear direction toward the front portion 1640 or the rear portion 1650. Additionally, the shaft axis 2870 may have zero offset with the CG location 2880 in the top-to-sole direction or may be offset from the CG location 2880 toward the top portion 1660 or the sole portion 1710. In one example, the shaft axis 2870 and the CG location 2880 may be offset by a distance greater than or equal to 0 mm and less than or equal to 5 mm in the top-to-sole direction toward the top portion 1660 or the sole portion 1710. In another example, the shaft axis 2870 and the CG location 2880 may be offset by a distance greater than or equal to 0 mm and less than or equal to 4 mm in the top-to-sole direction toward the top portion 1660 or the sole portion 1710. In yet another example, the shaft axis 2870 and CG location 2880 may be offset by a distance greater than or equal to 0 mm and less than or equal to 3 mm in the top-to-sole direction toward the top portion 1660 or the sole portion 1710. The amount of offset, if any, between the shaft axis 2870 and the CG location 2880 in the front-to-rear direction and/or the top-to-sole direction may be similar or different to the amount of offset between the shaft axis 2870 and the CG location 2880 in the heel-to-toe direction. Accordingly, any distance separating the shaft axis 2870 from the CG location 2880 in the front-to-rear direction and/or the top-to-sole direction may be similar or different to any of the distance 2890 examples described herein. In examples where the shaft axis 2870 is offset from the CG location 2880 toward the toe portion 1620. the hosel portion 1670 may allow the golf club head 1600 to balance in a toe-up position as shown in FIG. 30. For example, when the hosel portion 1670 is connected to a golf shaft resting on a flat horizontal surface and the golf club head 1600 is allowed to hang freely over an edge, the toe portion 1620 of the golf club head 1600 may point naturally in an upward direction such that a hang angle 3000 may be formed between a face plane 3010 and a horizontal plane 3020 parallel to or coinciding with the flat horizontal surface. In one example, the hang angle 3000 may be greater than 0 degrees and less than or equal to 45 degrees. In another example, the hang angle 3000 may be greater than or equal to 45 degrees and less than or equal to 90 degrees. In yet another example, the hang angle 3000 may be greater than or equal to 90 degrees and less than or equal to 135 degrees. In yet another example, the hang angle 3000 may be greater than or equal to 135 degrees and less than 180 degrees. A golf club employing a golf club head that balances toe-up may provide a similar feel to a face balanced golf club while also promoting greater face awareness compared to a conventional face balanced golf club. The apparatus, methods, and articles of manufacture described herein are not limited in this regard.

Figure 31:
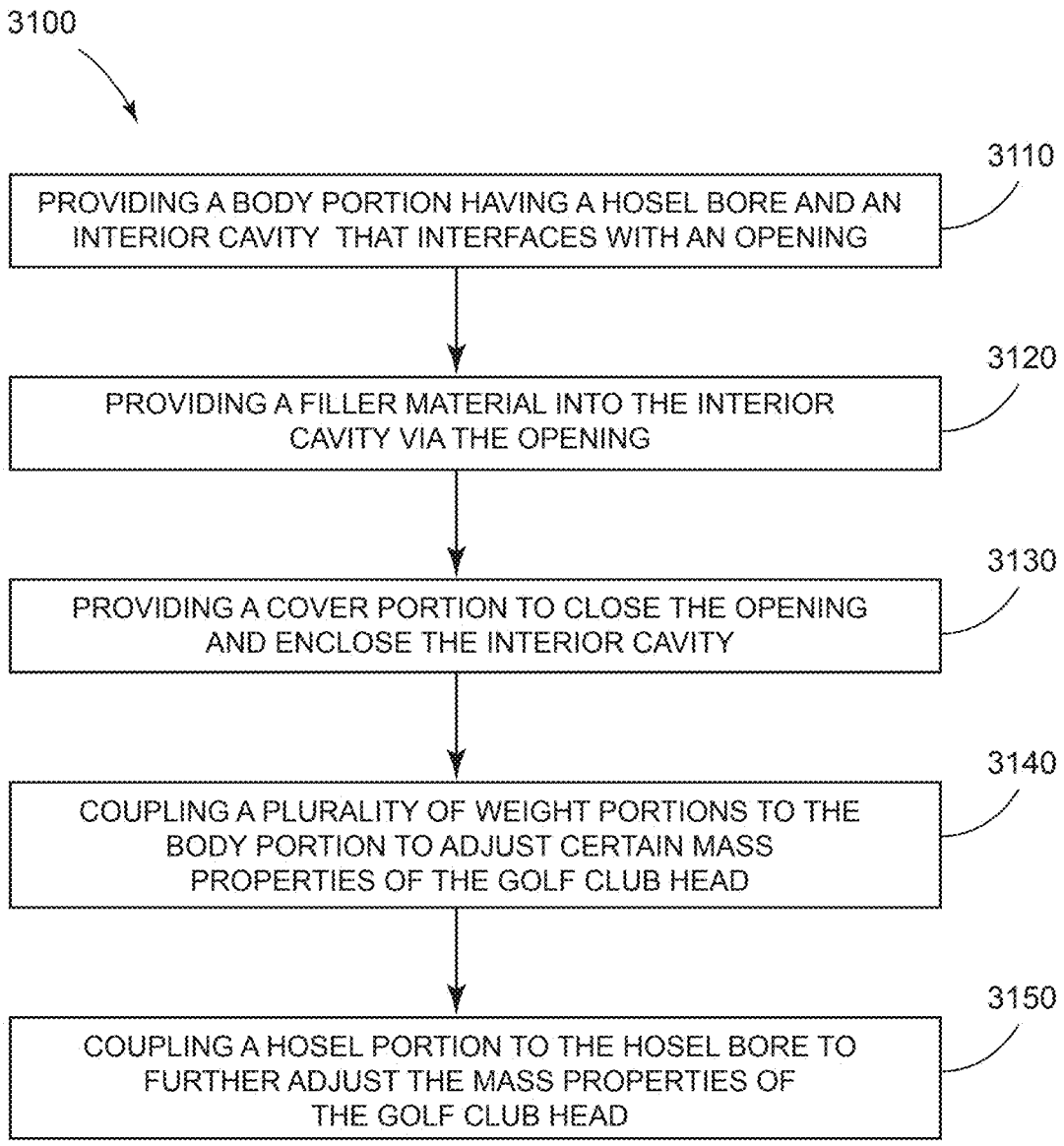
FIG. 31 depicts a manner in which any of the example golf club heads described herein may be manufactured according to an embodiment of the apparatus, methods, and articles of manufacture described herein.

FIG. 31 depicts one manner by which any of the golf club heads described herein may be manufactured. In the example of FIG. 31, a process 3100 may begin with providing a body portion having a hosel bore and an interior cavity that interfaces with an opening (block 3110). A filler material may be provided into the interior cavity via the opening (block 3120). In one example, the filler material may be adapted as an injectable liquid polymer material and later hardened using a curing process. In another example, the filler material may be adapted as an insertable solid polymer material. As described herein, the filler material may reinforce a face portion of the golf club head and may enable greater discretionary mass placement in other areas of the golf club head to optimize certain mass properties such as MOI, CG location, and mass balance. A cover portion may be provided to close the opening and enclose the interior cavity (block 3130). A plurality of weight portions may be coupled to the body portion to adjust certain mass properties of the golf club head (block 3140). A hosel portion may be coupled to the hosel bore to further adjust the mass properties of the golf club head (3150). As described herein, the hosel portion may be selected from a variety of different hosel types based on a golfer's swing type and swing tendencies. In one example, the hosel portion may be configured to orient a shaft axis toe-ward relative to a CG location of the golf club head such that the golf club head balances in a toe-up position. The apparatus, methods, and articles of manufacture described herein are not limited in this regard.

Figure 32:
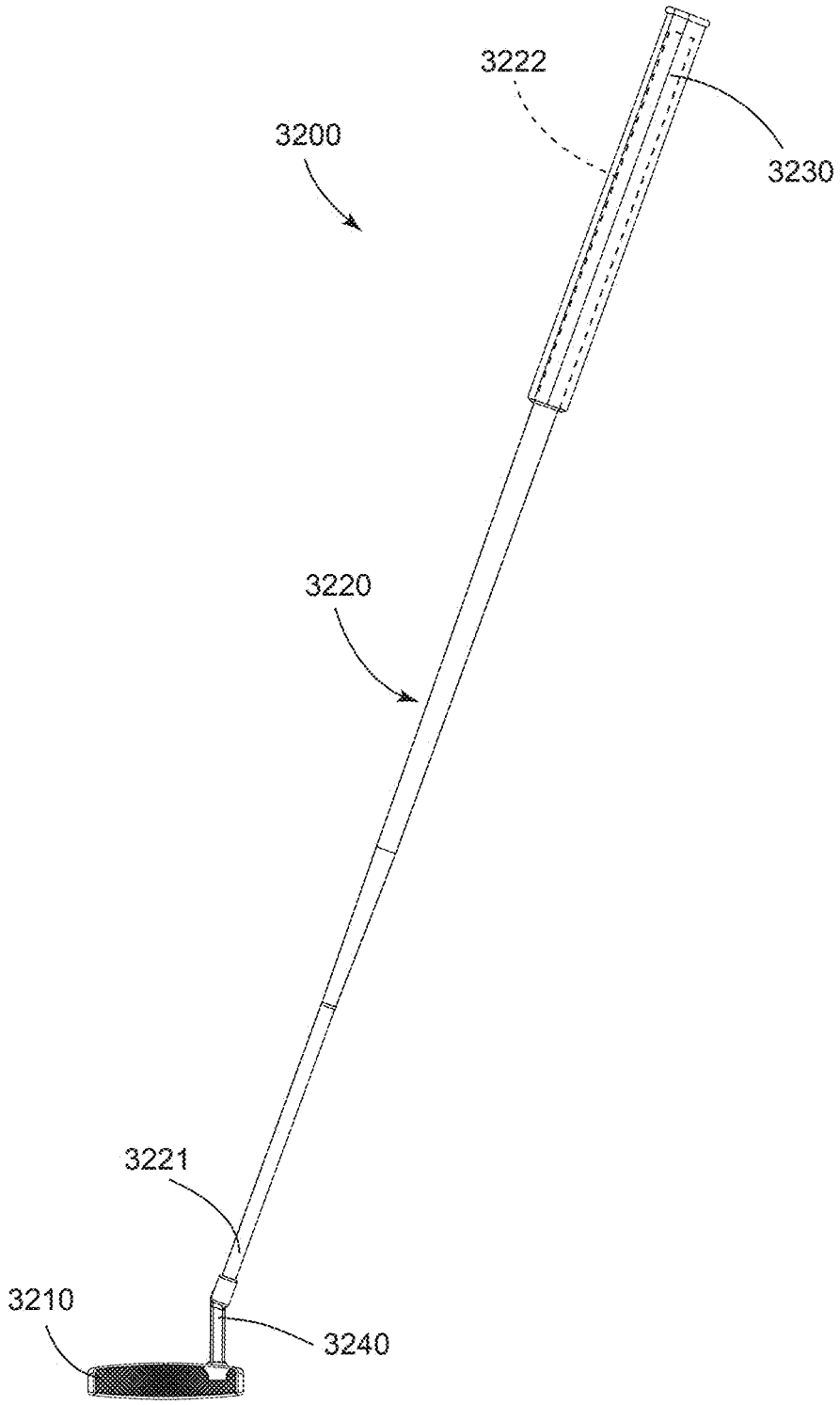
FIG. 32 depicts a golf club having a golf club head according to any embodiment of the apparatus, methods, and articles of manufacture described herein.

In the example of FIG. 32, a golf club 3200 may include a golf club head 3210, a shaft 3220, a grip 3230, and a hosel portion 3240. The shaft 3220 may have a tip end portion 3221 and a butt end portion 3222. The butt end portion 3222 of the shaft 3220 may be coupled to the grip 3230 and the tip end portion 3221 of the shaft 3220 may be coupled to the hosel portion 3240. The hosel portion 3240 may be coupled to the golf club head 3210 via a hosel bore as described herein. The golf club head 3210 and the hosel portion 3240 may include any of the golf club heads and hosel types described herein. The shaft 3220 may be formed from a metal material, a composite material, or any other suitable material or combination of materials. The grip 3230 may be formed from a rubber material, a polymer material, or any other suitable material or combination of materials. The apparatus, methods, and articles of manufacture described herein are not limited in this regard.

Figure 33:
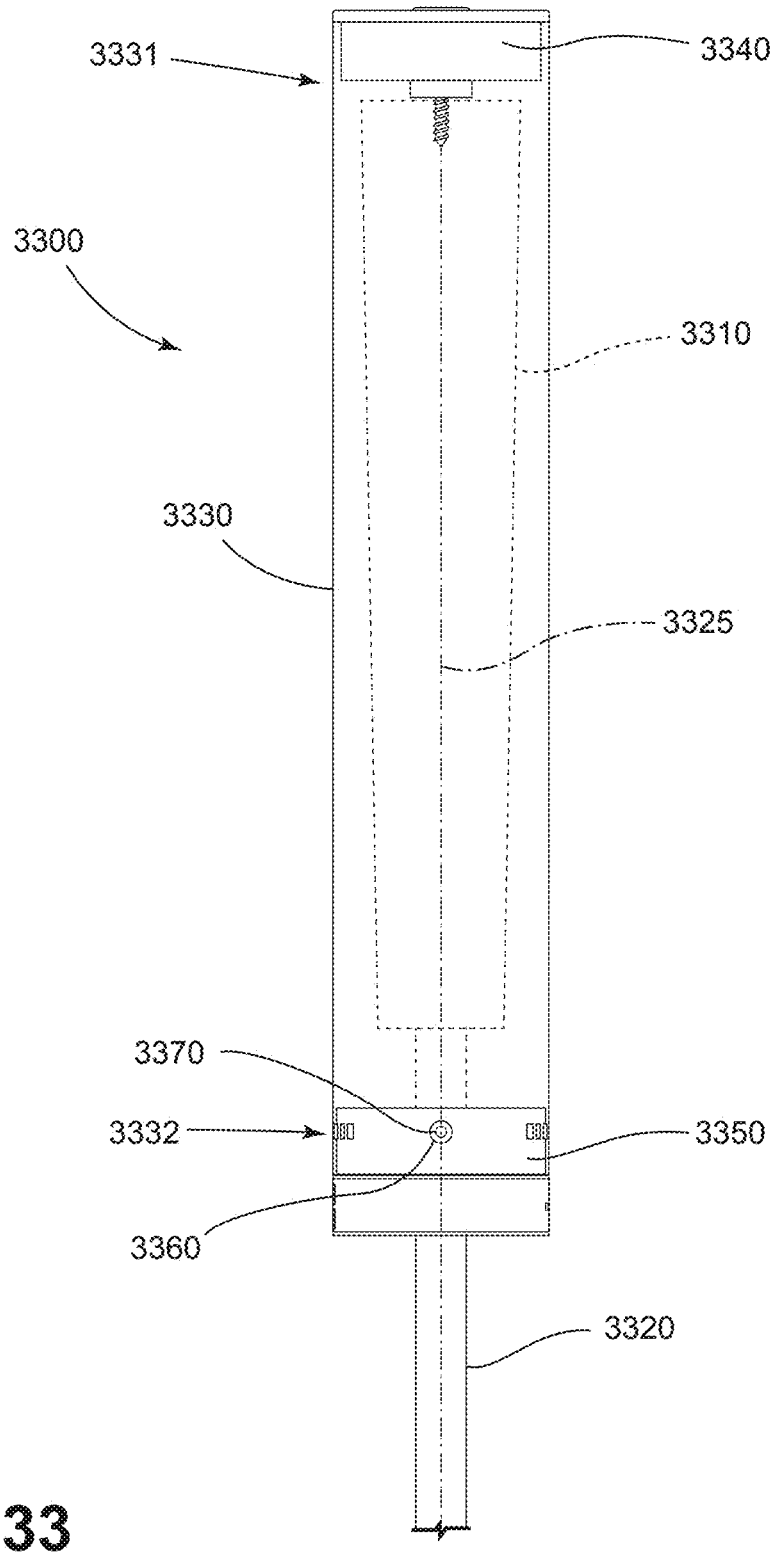
FIG. 33 depicts a grip attachment device according to an embodiment of the apparatus, methods, and articles of manufacture described herein.
Figure 34:
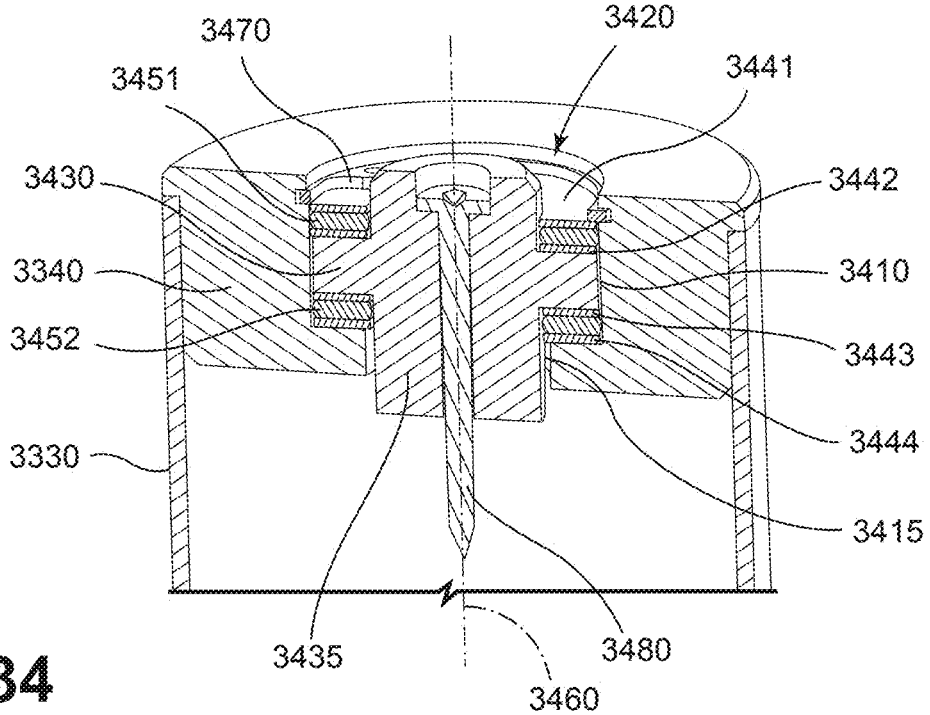
FIG. 34 depicts a schematic cross-sectional view of an upper portion of the grip attachment device of FIG. 33.
Figure 35:
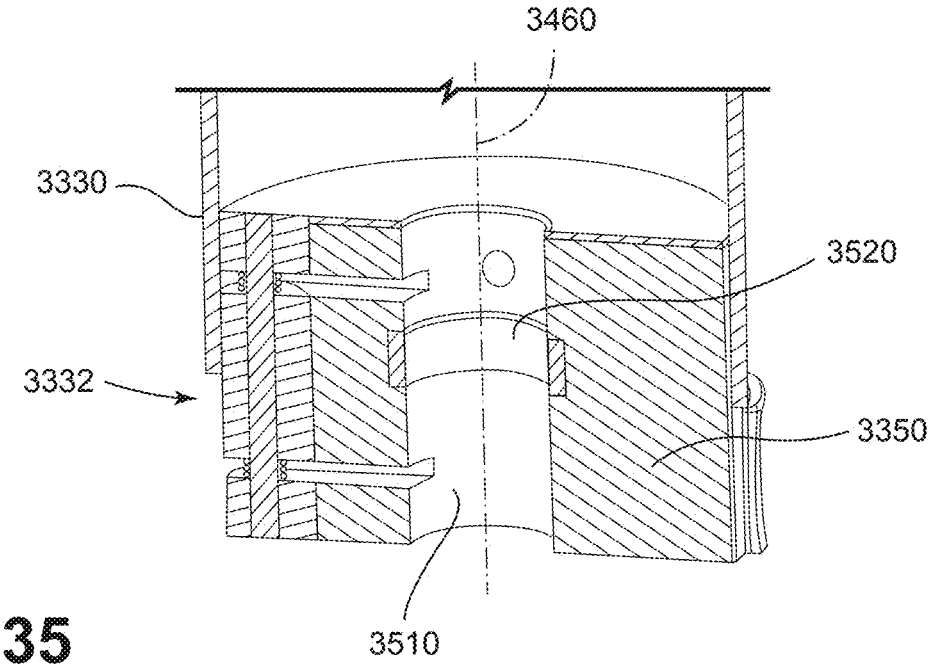
FIG. 35 depicts a schematic cross-sectional view of a lower portion of the grip attachment device of FIG. 33.
Figure 36:
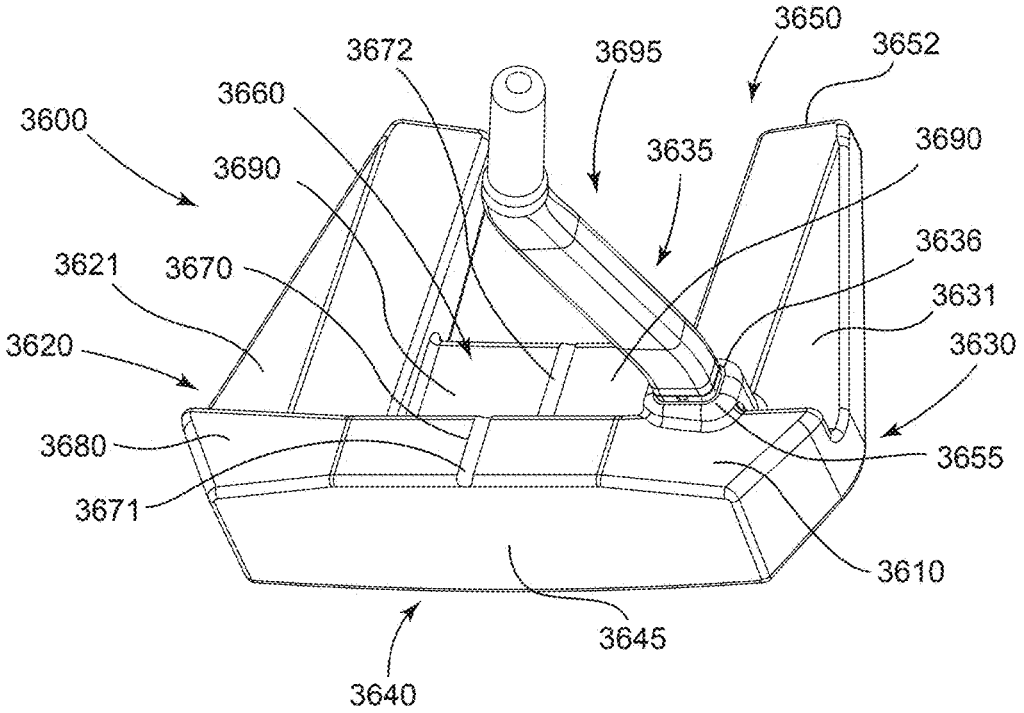
FIG. 36 depicts a perspective front view of a golf club head according to an embodiment of the apparatus, methods, and articles of manufacture described herein.

In the example of FIGS. 33-35, a grip attachment device 3300 is shown for demonstrating how a putter-type golf club behaves during a putting stroke. As described below, the grip attachment device 3300 allows the golf club to swing freely while highlighting the effects of torque and natural rotation. In the illustrated example, the grip attachment device 3300 may be configured to encase a grip 3310 and an upper portion of a shaft 3320 of a golf club and may be configured to enable the golf club to freely rotate about a shaft axis 3325. When the grip attachment device is fitted to a golf club and the golf club is swung while holding the grip attachment device 3300, the golf club may undergo rotation (e.g., twist) based on certain mass balance properties of the golf club head. For example, when a putting stroke is performed using the grip attachment device 3300 fitted to a golf club employing the golf club head 1600 described herein, the golf club head 1600 may remain square or substantially square to the stroke path, or in other words, may exhibit little to no twist despite the golf club being free to rotate. This may be attributed to the golf club head 1600 having a hosel portion (e.g., hosel portion 1670) located at a heel portion (e.g., heel portion 1630) and configured to direct a shaft axis (e.g., shaft axis 2870) toe-ward from a center of gravity location (e.g., center of gravity location 2880). Accordingly, a golf club utilizing the golf club head 1600 may be considered torque resistant as a result of exhibiting little to no rotation when a putting stroke is performed using the grip attachment device 3300. In contrast, a golf club that is not torque resistant may exhibit moderate to high degrees of rotation when a putting stroke is performed using the grip attachment device 3300. The apparatus, methods, and articles of manufacture described herein are not limited in this regard.

In the example of FIGS. 33-35, the grip attachment device 3300 may include a housing generally shown as a tubular portion 3330 having an upper end portion 3331 and a lower end portion 3332. The tubular portion 3330 may be made from a transparent or semitransparent polymer material to enable a user to see the contents contained therein. A plug portion 3340 may be coupled to the upper end portion 3331 and a clamp portion 3350 may be coupled to the lower end portion 3332. In one example, the plug portion 3340 may be removably coupled (e.g., frictionally coupled) to the upper end portion 3331. In another example, the plug portion 3340 may be fixedly secured to the upper end portion 3331 using mechanical fasteners, adhesive, and the like. In yet another example, the plug portion 3340 may be integral with the tubular portion. The plug portion 3340 may include a port 3410 with an opening 3415 in communication with an interior space of the tubular portion 3330. A torque assembly 3420 may be disposed within the port 3410 and may include a spacer 3430 interposed between a plurality of washers (e.g., shown as washers 3441, 3442, 3443, and 3444) and a plurality of rolling bearings (e.g., shown as rolling bearings 3451 and 3452). In the illustrated example, the spacer 3430 may include a central body portion 3435 that may extend through the plurality of washers and the plurality of rolling bearings. The central body portion 3435 may protrude through the opening 3415 and into the interior space of the tubular portion 3330. The spacer 3430, the plurality of washers, and the plurality of rolling bearings may be concentrically aligned about a center longitudinal axis 3460 of the tubular portion 3330. The torque assembly 3420 may be secured inside the port 3410 via a retaining ring 3470 coupled to the port 3410 and configured to prevent the torque assembly 3420 from becoming dislodged from the port 3410. A fastener 3480 may extend downward through the central body portion 3435 and into the interior space of the tubular portion 3330. In one example, the fastener 3480 may be configured as a screw threaded through the central body portion 3435. The spacer 3430 may be made of a low friction material such as, but not limited to, Delrin®, to enable the spacer 3430 to freely rotate about the center longitudinal axis 3460 of the tubular portion 3330. In the illustrated example, the clamp portion 3350 may be removably coupled to the lower end portion 3332. The clamp portion 3350 may have a clamshell design and may be spring-loaded to an open position when the clamp portion 3350 is removed from the tubular portion 3330. The clamp portion 3350 may have one or more detents (e.g., detent 3360 in FIG. 33), each configured to engage a corresponding aperture (e.g., aperture 3370 in FIG. 33) at the lower end portion 3332 of the tubular portion 3330. The clamp portion 3350 may additionally include a bore 3510 for encasing an upper portion of the shaft 3320. The bore 3510 may be concentrically aligned with the center longitudinal axis 3460 of the tubular portion 3330. Additionally, the bore 3510 may be at least partially lined with a low friction material 3520 such as, but not limited to, a wool lining. In this manner, the shaft 3320 may freely rotate within the clamp portion 3350 with little impediment. The apparatus, methods, and articles of manufacture described herein are not limited in this regard.

In assembly, the clamp portion 3350 may be removed from the tubular portion 3330 to enable the grip 3310 and shaft 3320 portion to be received inside the tubular portion 3330 via the lower end portion 3332. The fastener 3480 may be screwed into the top of the grip 3310, thereby securing the grip 3310 to the spacer 3430 and allowing the golf club and the spacer 3430 to freely rotate in unison. In one example, the fastener 3480 may be screwed into a grip hole commonly found at the top of conventional grips. In another example, a golf club may be outfitted with a dedicated grip configured to readily accept the fastener 3480. Once the grip is properly secured within the tubular portion 3330, the clamp portion 3350 may be returned to a closed position to encase the shaft 3320 within the bore 3510 and subsequently inserted back into the tubular portion 3330 via the lower end portion 3332 by sliding the clamp portion 3350 upward along the shaft 3320 until the detent 3360 engages the corresponding aperture 3370 at the lower end portion 3332 of the tubular portion 3330. In practice, the grip attachment device 3300 may be used by fitters, instructors, and/or golf equipment retailers and manufacturers to assist golfers in understanding the effects of torque and rotation for a particular golf club. By providing visual confirmation of a golf club's natural tendency to rotate or twist during a putting stroke, golfers may be better informed during the golf club selection process and may be able to quickly identify a golf club that best suits their individual skillsets and tendencies. For example, a golf club employing the golf club head 1600 described herein may be desirable for golfers seeking to simplify their putting strokes. Since a golf club employing the golf club head 1600 may exhibit a greater level of torque resistance, a golfer may experience little to no need to manipulate the golf club to achieve a square face at impact, potentially leading to more consistent and accurate putts. The apparatus, methods, and articles of manufacture described herein are not limited in this regard.

In the example of FIGS. 36-41, a golf club head 3600 is generally shown as a mid-mallet or mallet type putter head. However, the principles described herein may be similarly adopted to a blade or other type of putter head. As described in greater detail below, the golf club head 3600 may be similar in some respects to the golf club head 1600 described herein with reference to FIGS. 16-30. In particular, the golf club head 3600 may be configured with mass properties that promote higher levels of torque resistance while maintaining stability throughout a putting stroke. Accordingly, a golf club featuring the golf club head 3600 of the present disclosure may exhibit minimal rotation or twisting when a putting stroke is performed using the grip attachment device 3300 described previously herein. As described herein, a golf club designed to minimize rotation or twisting during a putting stroke may reduce or eliminate club manipulations in order to achieve a square face at impact. As a result, the golf club may promote a more consistent stroke path and face angle at impact. Having a square face at impact may enable golfers to hit putts closer to the intended target line, thereby improving precision and inspiring confidence. Additionally, consistent face alignment and reduced twisting may lead to more predictable ball speed and roll, potentially improving distance control. The golf club may suit a variety of swing types, including both straight-back-straight-through putting strokes and are putting strokes. Given these benefits, a golf club featuring the golf club head 3600 may offer a versatile option capable of satisfying the needs of different golfers, particularly those struggling to square the face. The apparatus, methods, and articles of manufacture described herein are not limited in this regard.

In the example of FIGS. 36-41, the golf club head 3600 may include a body portion 3610 having a toe portion 3620 with a toe portion edge 3622, a heel portion 3630 with a heel portion edge 3632, a hosel portion 3635 coupled to a hosel bore 3636, a front portion 3640 with a face portion 3645, a rear portion 3650 with a rear portion edge 3652, a top portion 3660 with a top portion edge 3662, and a sole portion 3710 with a sole portion edge 3712. An alignment aid 3670 may be located at the top portion 3660 and may extend between the front portion 3640 and the rear portion 3650. The alignment aid 3670 may be configured as a recessed line that coincides with a center longitudinal plane 3720, which may be a plane that bisects the body portion 3610 to define the toe portion 3620 and the heel portion 3630. The alignment aid 3670 may be segmented into a first portion 3671 located at a forward portion 3680 of the body portion 3610 and a second portion 3672 located at a ledge portion 3690 positioned aft of the forward portion 3680 and extending between a toe-side wing portion 3621 and a heel-side wing portion 3631. When the golf club head 3600 is viewed from above (e.g., at an address position to strike a golf ball such as the golf ball 2900), the first portion 3671 of the alignment aid 3670 may align with the second portion 3672 of the alignment aid 3670 to give the appearance of a single straight line. The toe-side wing portion 3621 and the heel-side wing portion 3631 may each extend rearwardly from the forward portion 3680 and may cooperate with the ledge portion 3690 to define a gap 3695. In one example, the golf club head 3600 may be used to pick up a golf ball by positioning the gap 3695 over the golf ball and pressing the golf club head 3600 onto the golf ball such that the golf ball becomes lodged or pinched between the toe-side wing portion 3621 and the heel-side wing portion 3631. In the illustrated example, the hosel bore 3636 may be formed in a hosel receptacle portion 3685 extending rearwardly from the forward portion 3680 and extending upwardly from the heel-side wing portion 3631. In one example, the hosel receptacle portion 3685 may be integral with the heel-side wing portion 3631 and a back wall portion 3681 of the forward portion 3680 that may generally oppose the face portion 3645. In another example, the hosel receptacle portion 3685 may be separate from the forward portion 3680 and may correspond to a standalone structure extending upwardly from the heel-side wing portion 3631. The apparatus, methods, and articles of manufacture described herein are not limited in this regard.

The body portion 3610 may be made from any of the material and/or processes described herein or described in any of the incorporated by reference documents. Additionally, the body portion 3610 may include any of the features described herein or described in any of the incorporated by reference documents. Such features may include, but are not limited to, one or more weight ports and corresponding weight portions and/or a filler material housed within a cavity of the body portion 3610. For purposes of clarity, the face portion 3645 is generally shown having a flat surface without any face features (e.g., grooves, protrusions, etc.). However, in practice, the face portion 3645 may be configured according to any example face portion described herein or described in the incorporated by reference documents. In one example, the face portion may be configured with a face pattern similar to the face pattern described herein with reference to FIGS. 10-12 and may be supported by a filler material located behind at least a portion of the face portion 3645. Accordingly, the face portion 3645 may benefit from a thin face design and may be configured with any of the face thicknesses described herein or described in the incorporated by reference documents. The apparatus, methods, and articles of manufacture described herein are not limited in this regard.

Figure 37:
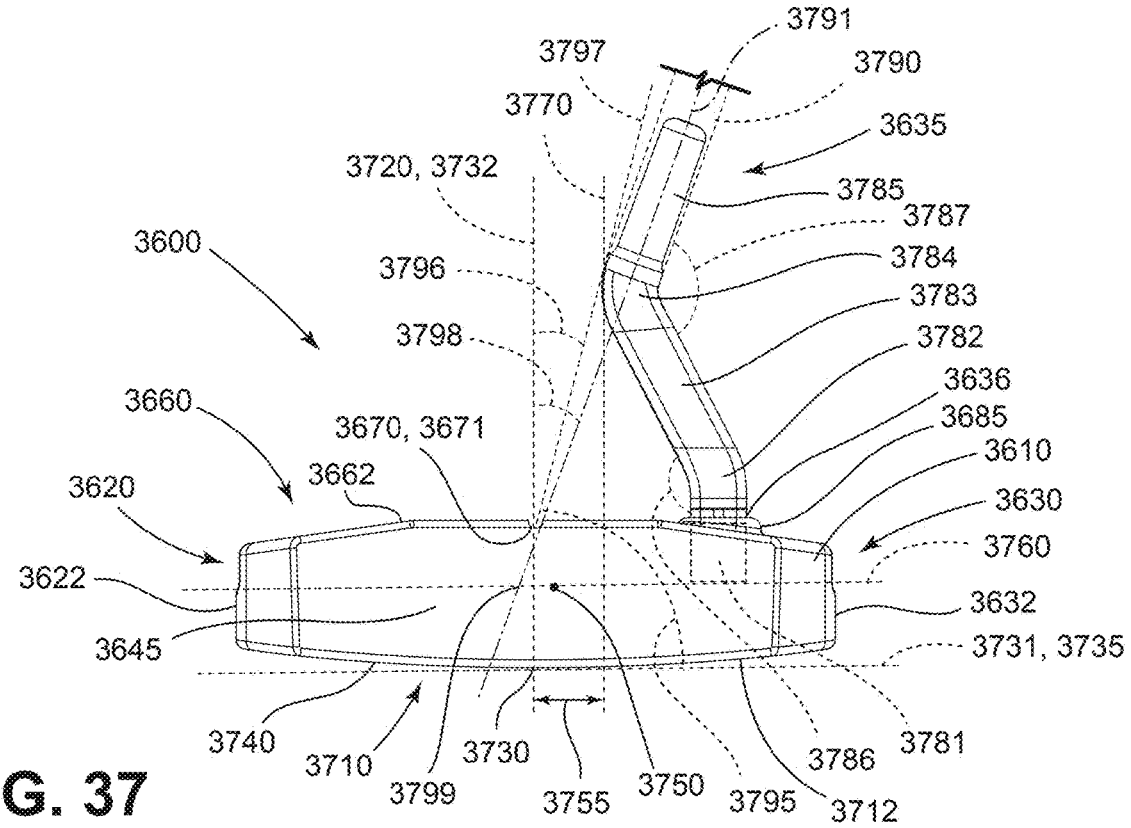
FIG. 37 depicts a front view of the golf club head of FIG. 36.
Figure 38:
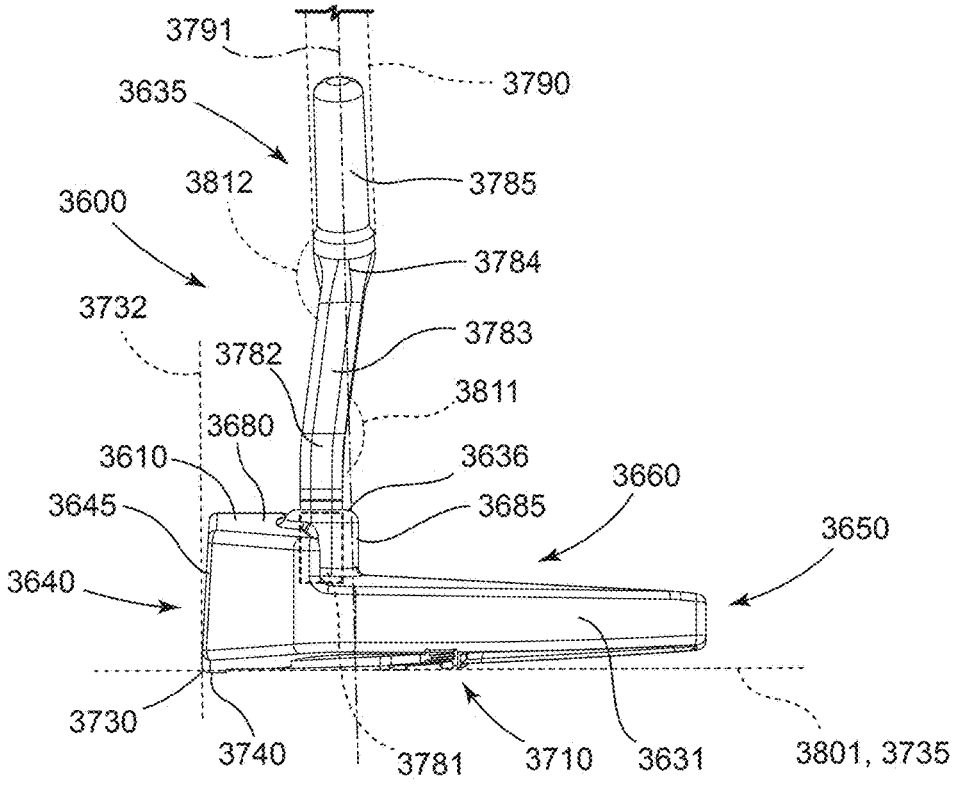
FIG. 38 depicts a heel-side view of the golf club head of FIG. 36.
Figure 39:
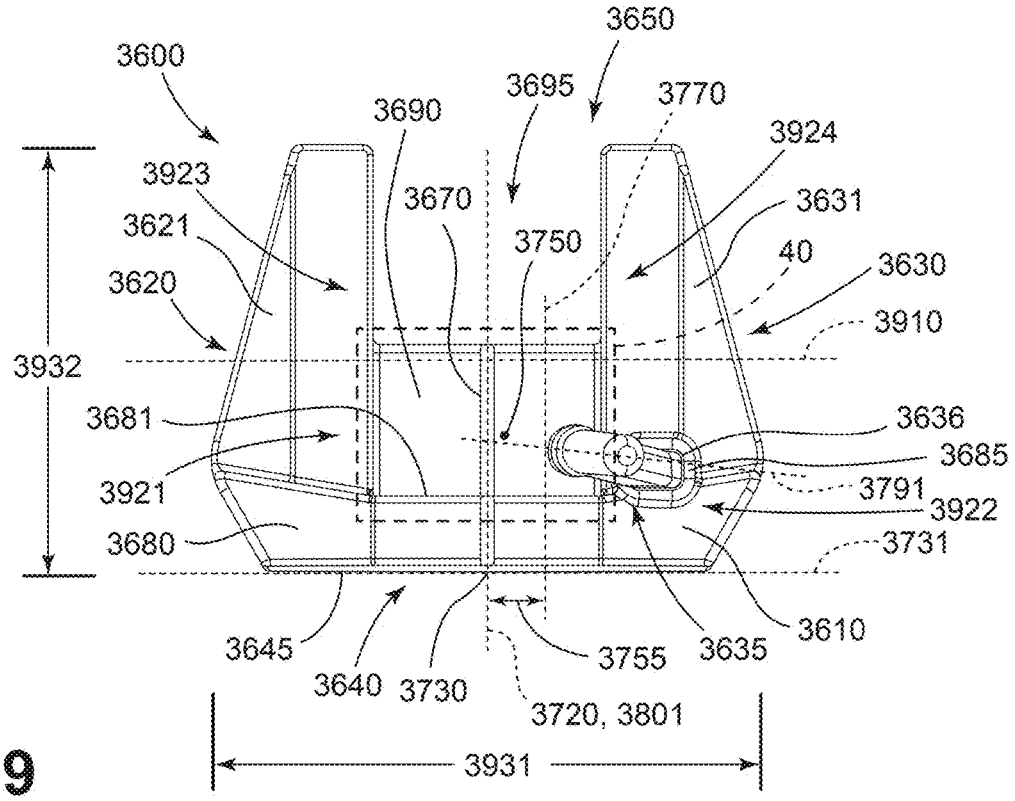
FIG. 39 depicts a top view of the golf club head of FIG. 36.

FIGS. 37-39 show a reference coordinate system for the golf club head 3600. The coordinate system may include an origin 3730, an x-axis 3731, a y-axis 3732, and a z-axis 3801. In the illustrated example, the origin 3730 may correspond to a midpoint of a leading edge 3740 of the golf club head 3600. The leading edge 3740 may join the sole portion 3710 to the face portion 3645 and the midpoint of a leading edge 3740 may be located halfway between the toe portion edge 3622 and the heel portion edge 3632. The x-axis 3731 may extend between the toe portion 3620 and the heel portion 3630. The portion of the x-axis 3731 extending from the origin 3730 in a toe-ward direction or toward the toe portion edge 3622 may include negative x-axis values, and the portion of the x-axis 3731 extending from the origin 3730 in a heel-ward direction or toward the heel portion edge 3632 may include positive x-axis values. The y-axis 3732 may extend between the top portion 3660 and the sole portion 3710. The portion of the y-axis 3732 extending from the origin 3730 in a sole-to-top direction may include positive y-axis values whereas negative y-axis values may fall below the sole portion 3710. The z-axis 3801 may extend between the front portion 3640 and the rear portion 3650. The portion of the z-axis 3801 extending from the origin 3730 in a front-to-rear direction or toward the rear portion edge 3652 may encompass negative z-axis value whereas positive z-axis values may typically fall forward of the face portion 3645. The apparatus, methods, and articles of manufacture described herein are not limited in this regard.

FIG. 39 shows a quadrant system about the golf club head 3600. The quadrant system may include a center lateral plane 3910 that intersects with the center longitudinal plane 3720 to define a front-toe quadrant 3921, a front-heel quadrant 3922, a rear-toe quadrant 3923, and a rear-heel quadrant 3924. In one example, the center longitudinal plane 3720 may equally divide a length 3931 of the body portion 3610 between the toe portion 3620 and the heel portion 3630 whereas the center lateral plane 3910 may equally divide a length 3932 of the body portion 3610 between the front portion 3640 and the rear portion 3650. The center longitudinal plane 3720 may coincide with the y-axis 3732 and the z-axis 3801 and may be perpendicular with a ground plane 3735 that may include any flat surface on which the golf club head 3600 rests at an address position to strike a golf ball. In one example the ground plane 3735 may coincide with the x-axis 3731 and the z-axis 3801. The center lateral plane 3910 may be perpendicular to the center longitudinal plane 3720 and the ground plane 3735 and may be parallel with the x-axis 3731. The apparatus, methods, and articles of manufacture described herein are not limited in this regard.

In the example of FIGS. 36-41, the golf club head 3600 may be configured with a center of gravity (CG) 3750 located heel-ward (e.g., having a positive x-axis value) from the center longitudinal plane 3720. Positioning the CG 3750 heel-ward may enhance stability and feedback. For example, the golf club head 3600 may provide amplified feedback for off-center hits to assist golfers in refining their stroke and impact consistency. In the illustrated example, the CG 3750 may be located on an intersection between a horizontal plane 3760 and a vertical plane 4010 that intersect the center longitudinal plane 3720. The horizontal plane 3760 may be parallel to the ground plane 3735 and may be perpendicular to the center longitudinal plane 3720. The vertical plane 4010 may be perpendicular to the horizontal plane 3760, the center longitudinal plane 3720, and the ground plane 3735. In one example, the CG 3750 may be located in the front-heel quadrant 3922 within a CG zone 3755 that may include any x-axis value on the x-axis 3731 bounded by the center longitudinal plane 3720 and a boundary plane 3770, which is a plane that is parallel to the center longitudinal plane 3720 and defines a toe-side boundary of the hosel portion 3635. In another example, the CG 3750 may include an x-axis value located outside the CG zone 3755 (i.e., on or beyond the boundary plane 3770 in the heel-ward direction). In yet another example, the CG 3750 may coincide with the center longitudinal plane 3720 or may be located in the front-toe quadrant 3921 thereby encompassing any negative x-axis values. The apparatus, methods, and articles of manufacture described herein are not limited in this regard.

In the example of FIGS. 36-41, the CG 3750 coordinates may vary with respect to the y-axis 3732 and the z-axis 3801. In the illustrated example, the CG 3750 may have a y-axis value located closer to the top portion 3660 than to the sole portion 3710 and a z-axis value located closer to the front portion 3640 than to the rear portion 3650. The benefits of a higher CG 3750 may include improved roll consistency, better energy transfer, enhanced feel, and stability on mishits. For example, a higher CG 3750 may be positioned closer to a golf ball's equator, thereby imparting more immediate topspin, which may promote a smoother roll. Impact closer to the CG 3750 may reduce energy loss, resulting in greater strike efficiency. A higher CG 3750 may also produce a crisp, solid feel at impact due to the face portion 3645 interacting more directly with the golf ball's equator. A higher CG 3750 may further be balanced with perimeter weighting to maintain stability and impart forgiveness on off-center strikes. The benefits of a forward CG 3750 may include increased ball speed and distance control, reduced face rotation, and improved responsiveness. For example, a forward CG 3750 may transfer more energy directly to a golf ball, resulting in higher ball speeds for the same swing effort, thereby aiding golfers in achieving better distance control. A forward CG 3750 may also lower a moment of inertia (MOI) of the golf club head 3600 about a shaft axis 3791, which may reduce face rotation or twisting during a putting stroke. A forward CG 3750 may further produce a responsive feel at impact, aiding golfers in making smoother, more controlled putting strokes. In other examples, the CG 3750 may have a y-axis value located closer to the sole portion 3710 than to the top portion 3660 and/or a z-axis value located closer to the rear portion 3650 than to the front portion 3640. As described herein, the particular CG 3750 location may be dictated through perimeter weighting (e.g., via weight portions), material properties of the body portion, one or more interior cavities partially or entirely filled with a filler material, and/or material properties and attachment location of the hosel portion 3635. The apparatus, methods, and articles of manufacture described herein are not limited in this regard.

In the example of FIGS. 36-41, the hosel portion 3635 may be coupled to the body portion 3610 at the hosel receptacle portion 3685 via the hosel bore 3636. The hosel portion 3635 may be made from a material that is similar to or different from a material of the body portion 3610. In the illustrated example, the hosel portion 3635 may be located within the front-heel quadrant 3922. In another example, the hosel portion 3635 may be located within the rear-heel quadrant 3924. In yet another example, the hosel portion 3635 may be located at the ledge portion 3690. With respect to any of the examples provided herein, the hosel portion 3635 may be provided separately from the body portion 3610. Alternatively, the hosel portion 3635 may be integral with the body portion 3610 or otherwise attached to the body portion 3610. As shown in FIGS. 37 and 38, the hosel portion 3635 may include an insert portion 3781 (e.g., shown in phantom line), a first bend portion 3782, a neck portion 3783, a second bend portion 3784, and a tip portion 3785. The insert portion 3781 may be configured to be received inside the hosel bore 3636 and may be coupled to the hosel bore 3636 using an adhesive (e.g., an epoxy), using a mechanical fastener, by being press fit, and/or with other types of securing devices. Additional examples of insertable hosel portions may be found in the incorporated by reference documents. The apparatus, methods, and articles of manufacture described herein are not limited in this regard.

The first bend portion 3782 may extend from the insert portion 3781 and may be configured to direct the neck portion 3783 in a toe-ward direction. In one example, as shown in FIG. 37, the first bend portion 3782 may form a toe-ward bend angle 3786 in an x-y plane to impart a toe-ward lean to the neck portion 3783. The toe-ward bend angle 3786 may correspond to an angle formed between the toe-side extents of the insert portion 3781 and the neck portion 3783 when viewing the golf club head 3600 from the vantage point of FIG. 37. In one example, the toe-ward bend angle 3786 may be greater than or equal to 140 degrees and less than or equal to 160 degrees. In another example, the toe-ward bend angle 3786 may be greater than or equal to 145 degrees and less than or equal to 155 degrees. Additionally, in another example, the first bend portion 3782 may be configured to direct the neck portion 3783 in a rearward direction. The first bend portion 3782 may form a rearward bend angle 3811 in a y-z plane to impart a rearward lean to the neck portion 3783. The rearward bend angle 3811 may correspond to an angle formed between the rearward extents of the insert portion 3781 and the neck portion 3783 when viewing the golf club head 3600 from the vantage point of FIG. 38. In one example, the rearward bend angle 3811 may be greater than or equal to 165 degrees and less than or equal to 180 degrees. In another example, the rearward bend angle 3811 may be greater than or equal to 170 degrees and less than or equal to 175 degrees. The neck portion 3783 may extend linearly from the first bend portion 3782 in the toe-ward direction and the rearward direction and may terminate at the second bend portion 3784. The second bend portion 3784 may extend from the neck portion 3783 and may be configured to direct the tip portion 3785 in a heel-ward direction. In one example, the second bend portion 3784 may have a heel-ward bend angle 3787 in an x-y plane to impart a heel-ward lean to the tip portion 3785. The heel-ward bend angle 3787 may correspond to an angle formed between the heel-ward extents of the neck portion 3783 and the tip portion 3785 when viewing the golf club head 3600 from the vantage point of FIG. 37. In one example, the heel-ward bend angle 3787 may be greater than or equal to 125 degrees and less than or equal to 140 degrees. In another example, the heel-ward bend angle 3787 may be greater than or equal to 130 degrees and less than or equal to 135 degrees. Additionally, in another example, the second bend portion 3784 may be configured to direct the tip portion 3785 in a frontward direction. The second bend portion 3784 may have a frontward bend angle 3812 in a y-z plane to impart a forward lean to the tip portion 3785. The frontward bend angle 3812 may correspond to an angle formed between the frontward extents of the neck portion 3783 and the tip portion 3785 when viewing the golf club head 3600 from the vantage point of FIG. 38. In one example, the frontward bend angle 3812 may be greater than or equal to 163 degrees and less than or equal to 178 degrees. In another example, the frontward bend angle 3812 may be greater than or equal to 168 degrees and less than or equal to 173 degrees. In other examples, the hosel portion 3635 may be configured to impart zero shaft lean or rearward shaft lean. In the illustrated example, the tip portion 3785 may be cylindrical or substantially cylindrical and may be coaxial with a shaft axis 3791 of the shaft 3790. The shaft axis 3791 and the ground plane 3735 may form a lie angle 3795 measured when the golf club head 3600 rests flat (i.e., soled) on the ground plane 3735. In the illustrated example, the lie angle 3795 of the golf club head 3600 may be 70 degrees or approximately 70 degrees. Alternatively, the lie angle 3795 may be greater than or less than 70 degrees. In one example, the lie angle 3795 may be in a range greater than or equal to 60 degrees and less than or equal to 80 degrees (e.g., the United States Golf Association (USGA) currently limits a lie angle of a conforming putter to 80 degrees). While the hosel portion 3635 is generally described herein as being internally coupled to the shaft 3790 via the tip portion 3785, the hosel portion 3635 may be externally coupled to the shaft 3790 via a socket or otherwise coupled to the shaft 3790. The apparatus, methods, and articles of manufacture described herein are not limited in this regard.

Referring to FIG. 37, the golf club head 3600 may have a visibility angle 3796 in an x-y plane formed between the center longitudinal plane 3720 and a visibility plane 3797 that borders the toe-most extent (e.g., the second bend portion 3784) of the hosel portion 3635 and intersects the center longitudinal plane 3720 through the first portion 3671 of the alignment aid 3670. The visibility angle 3796 may represent a range of sightlines that enable an individual to fully see the alignment aid 3670 at an address position to strike a golf ball. Accordingly, so long as an individual's sightline falls within the visibility angle 3796, the individual may have full view of the alignment aid 3670. As illustrated in the present example, the visibility angle 3796 may help position an individual's head over the golf club head 3600 at address such that the individual's sightline may be closer to vertical (i.e., 90 degrees). In this way, when an individual's head is positioned over the golf club head 3600 at address, the individual may have a clear line of sight to the intended target, which may improve aim, stability, and/or control. In the present example, the golf club head 3600 may have a visibility angle 3796 greater than or equal to 10 degrees and less than or equal to 16 degrees for a lie angle 3795 of 70 degrees. In another example, the visibility angle 3796 may be greater than or equal to 5 degrees and less than or equal to 20 degrees, irrespective of the lie angle 3795. In another example, the golf club head 3600 may have a visibility angle greater than or equal to 0.5 degrees and less than or equal to 2 degrees for a lie angle greater than or equal to 75 degrees and less than or equal to 80 degrees). By providing a relatively narrow range of sightlines, a more optimal head position may be achieved to aid alignment at address. As an added visual feature, the hosel portion 3635, configured in accordance with the teachings provided herein, may be concealed or substantially concealed by the shaft 3790 when viewing the golf club head 3600 at address, as exemplarily shown in FIG. 41. In this manner, the golf club head 3600 may have a more minimalist appearance, giving the impression that the shaft 3790 is directly connected to the body portion 3610. By reducing visual clutter, a golfer may better focus on alignment and setting up to make a putting a stroke. The apparatus, methods, and articles of manufacture described herein are not limited in this regard.

Figure 40:
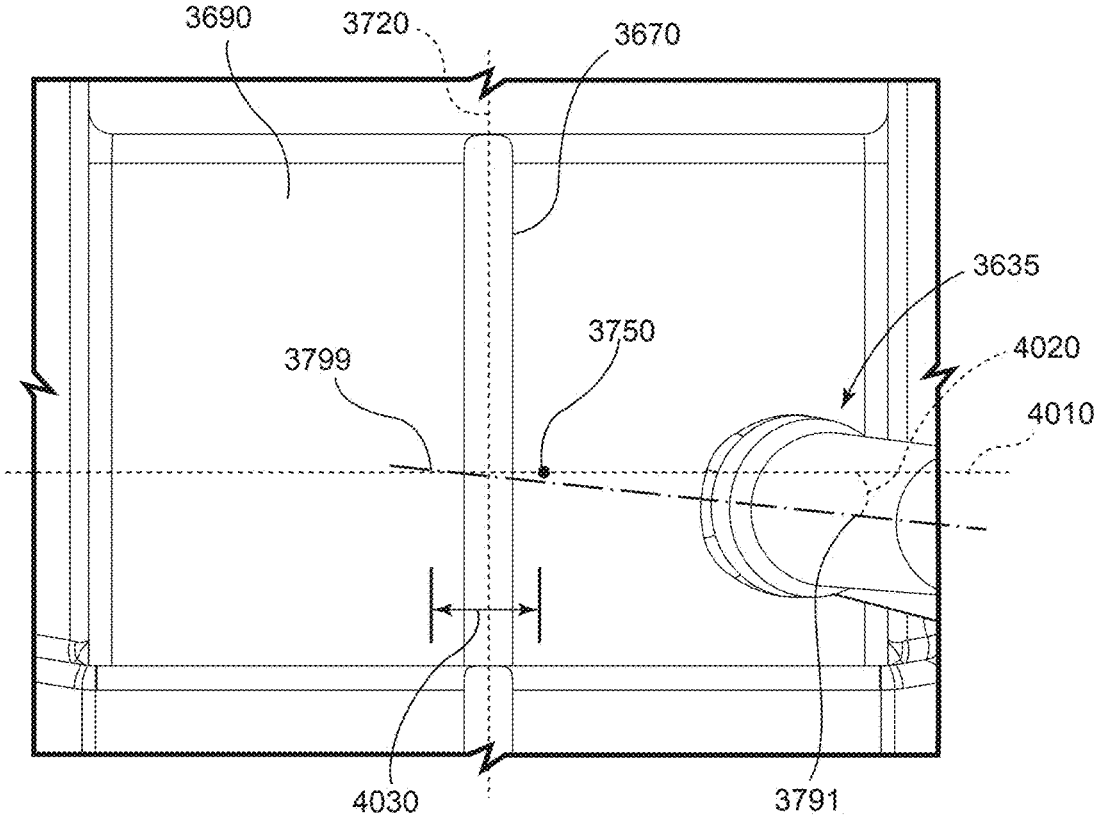
FIG. 40 depicts an enlarged view of an area of the golf club head designated by box 40 in FIG. 39.
Figure 41:
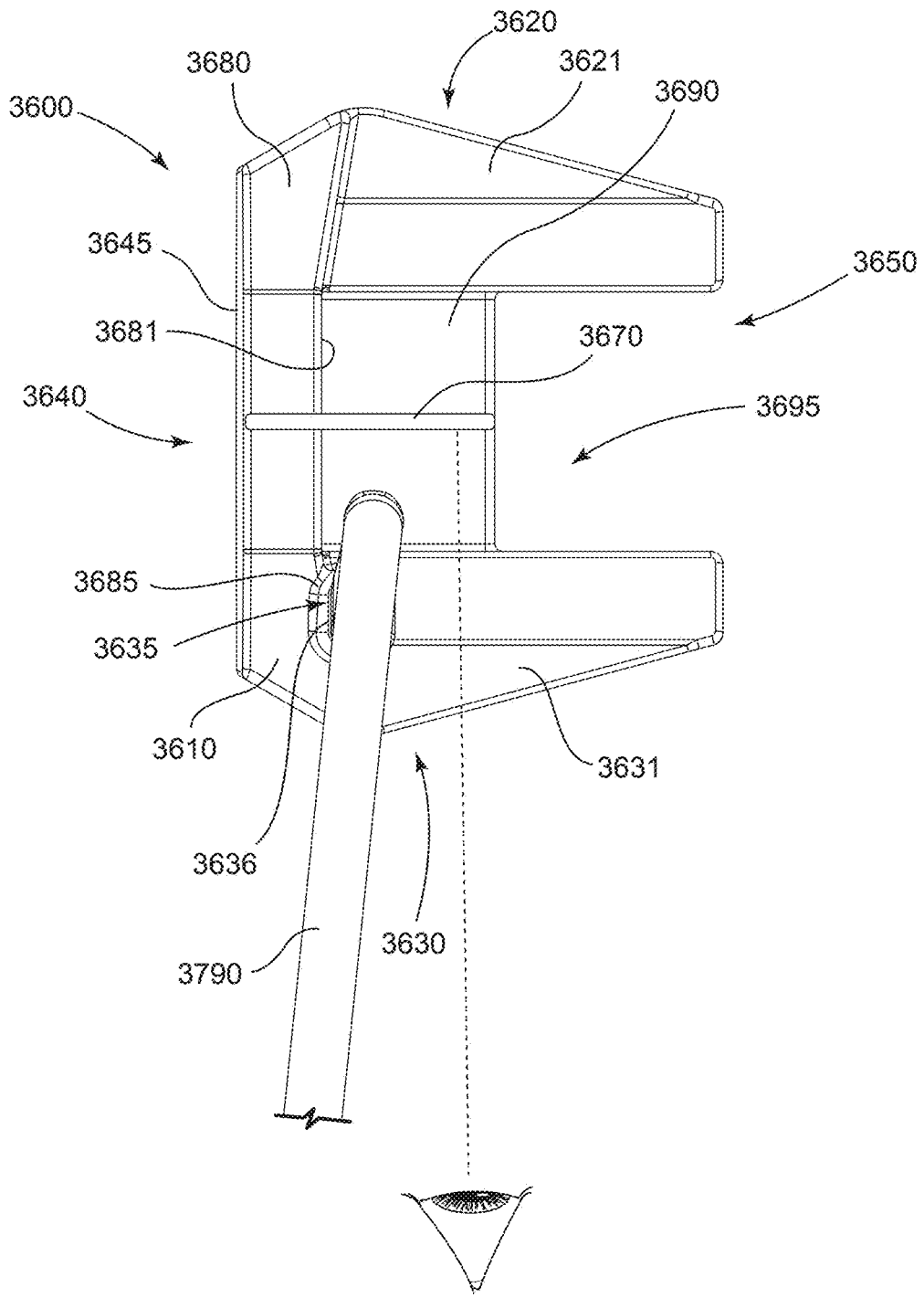
FIG. 41 depicts the golf club head of FIG. 36 at an address position to strike a golf ball.

With reference to FIGS. 37 and 40, the hosel portion 3635 may be configured to direct the shaft axis 3791 toe-ward from the CG 3750. Directing the shaft axis 3791 toe-ward from the CG 3750 which is positioned heel-ward may impart certain performance properties that may enhance putting performance for many golfers. The synergistic effects of positioning the CG 3750 heel-ward and directing the shaft axis 3791 toe-ward from the CG 3750 may provide a number of performance benefits, including enhanced face rotation dynamics, improved stability on off-center strikes, and increased feel and control. For example, a toe-ward shaft axis 3791 may produce a lever arm between the CG 3750 and the shaft 3790, potentially resulting in greater responsiveness to a golfer's stroke path and allowing the face portion 3645 to follow the stroke path more intuitively. A toe-ward shaft axis 3791 may help balance the mass distribution of the golf club head 3600, reducing face twisting on mishits or off-center strikes, thereby enhancing the stability imparted by a heel-ward CG 3750. The combination of a CG 3750 that is positioned heel-ward and a toe-ward shaft axis 3791 may enhance feedback on mishits and promote a smoother release, potentially improving touch and distance control. Accordingly, the synergistic effects of positioning the CG 3750 heel-ward and directing the shaft axis 3791 toe-ward from the CG 3750 may offer performance benefits that may differ from the performance benefits commonly associated with center-shafted golf clubs and heel-shafted golf clubs that direct a shaft axis through the CG or heel-ward of the CG. The apparatus, methods, and articles of manufacture described herein are not limited in this regard.

In the illustrated example, the hosel portion 3635 may be configured to direct the shaft axis 3791 toward the front-toe quadrant 3921 of FIG. 39. The shaft axis 3791 may intersect the horizontal plane 3760 and the vertical plane 4010 at an intersection point 3799 located toe-ward from the CG 3750. Given the forward lean of the shaft 3790 in the illustrated example, the shaft axis 3791 may extend toward the intersection point 3799 such that a portion of the shaft axis 3791 is located above and forward of the CG 3750 within the front-heel quadrant 3922. Accordingly, the hosel portion 3635 may include an offset to lean the shaft 3790 in a forward direction toward or extending frontward beyond the face portion 3645. By incorporating a forward shaft lean, a golfer's hands may be visually aligned closer toward a golf ball at address, which may encourage a forward press to stabilize the golfer's wrists and promote greater roll consistency. In one example, the shaft axis 3791 and the vertical plane 4010 may define an offset angle 4020 in an x-z plane that is greater than 0 degree and less than or equal to 8 degrees. In another example, the offset angle 4020 may be greater than or equal to 0.5 degree and less than or equal to 3 degrees. In yet another example, the hosel portion 3635 may be configured such that the shaft axis 3791 lies completely on the vertical plane 4010 and extends directly above the CG 3750 within the front-heel quadrant 3922. In yet another example, the hosel portion 3635 may be configured such that the shaft axis 3791 extends toward the intersection point 3799 and a portion of the shaft axis 3791 is located above and rearward of the CG 3750 within the front-heel quadrant 3922. The apparatus, methods, and articles of manufacture described herein are not limited in this regard.

In the example of FIGS. 36-41, the intersection point 3799 may have an x-axis value that is opposite and equal or substantially equal in magnitude to the x-axis value of the CG 3750. As defined herein, the term substantially shall mean that a given value is within 15% of a stated value, unless otherwise noted. Accordingly, the CG 3750 and the intersection point 3799 may be equidistant or substantially equidistant from the center longitudinal plane 3720. In the illustrated example, the intersection point 3799 and the CG 3750 may have opposite and equal or substantially equal x-axis values, equal or substantially equal y-axis values, and equal or substantially equal z-axis values. Thus, the CG 3750 and the intersection point 3799 may mirror or substantially mirror one another about the center longitudinal plane 3720. In another example, the intersection point 3799 and the CG 3750 may have x-values, y-values, and/or z-values that vary. Thus, the CG 3750 and the intersection point 3799 may be located at similar or different relative distances from the center longitudinal plane 3720. Accordingly, in other examples, the CG 3750 may be located closer to the center longitudinal plane 3720 and the intersection point 3799 may be located farther away from the center longitudinal plane 3720 or vice versa. The apparatus, methods, and articles of manufacture described herein are not limited in this regard.

With respect to any of the examples provided herein. the intersection point 3799 and the CG 3750 may be separated by an offset distance 4030 in a heel-to-toe direction along an axis defined by the intersection between the horizontal plane 3760 and the vertical plane 4010 that is greater than or equal to 0.140 inches (3.556 mm) and less than or equal to 0.260 inches (6.604 mm). In another example, the offset distance 4030 separating the intersection point and the CG may be greater than or equal to 0.160 inches (4.064 mm) and less than or equal to 0.240 inches (6.096 mm). In yet another example, the offset distance 4030 separating the intersection point and the CG may be greater than or equal to 0.180 inches (4.572 mm) and less than or equal to 0.220 inches (5.588 mm). By locating the intersection point 3799 toe-ward and in near proximity to the CG 3750, a ratio between a moment of inertia (MOI) about a vertical axis of the CG and an MOI about the shaft axis 3791 may be 1 (one) or approximately 1 (one). In one example, the ratio between the MOI about the vertical axis of the CG and the MOI about the shaft axis 3791 may be greater than or equal to 0.80 and less than or equal to 1.20. The ratio between the MOI of the vertical axis of the CG 3750 and the MOI about the shaft axis 3791 may provide an indication of how resistant the golf club head 3600 is to torque, where ratios closer to 1 (one) may signify higher levels of torque resistance and ratios farther away from 1 (one) may signify lower degrees of torque resistance. The aforementioned offset distances 4030 may represent a distance range between the intersection point 3799 and the CG 3750 that may optimize the synergistic effects of positioning the CG 3750 heel-ward and directing the shaft axis 3791 toe-ward from the CG 3750 as described herein. The apparatus, methods, and articles of manufacture described herein are not limited in this regard.

Figure 42:
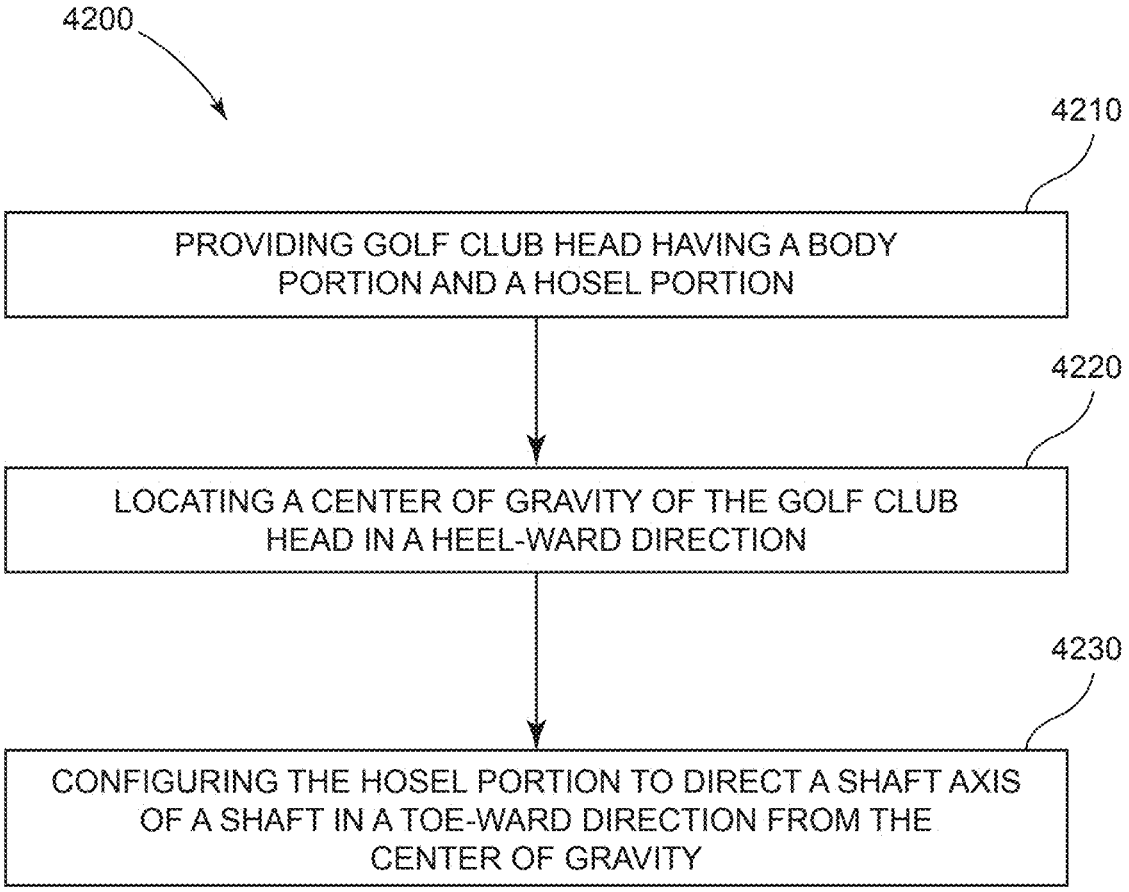
FIG. 42 depicts a manner in which any of the example golf club heads described herein may be manufactured according to an embodiment of the apparatus, methods, and articles of manufacture described herein.

FIG. 42 depicts one manner by which any of the golf club heads described herein may be manufactured. In the example of FIG. 42, a process 4200 may begin with providing a golf club head (e.g., golf club head 3600) having a body portion (e.g., body portion 3610) and a hosel portion (e.g., hosel portion 3635) (block 4210). In one example, the hosel portion may be coupled to a hosel receptacle portion (e.g., hosel receptacle portion 3655) provided at a heel portion (e.g., heel portion 3630) of the body portion. Additionally, the hosel portion may have one or more bend portions (e.g., first bend portion 3782 and second bend portion 3784) to impart a forward lean to the shaft. The process 4200 may also include locating a center of gravity (e.g., CG 3750) of the golf club head in a heel-ward direction (block 4220). As described herein, a heel-ward CG may offer enhanced stability and feedback along with improved alignment for many golfers. The process 4200 may further include configuring the hosel portion to direct a shaft axis (e.g., shaft axis 3791) of a shaft (e.g., shaft 3790) in a toe-ward direction from the center of gravity (block 4230). As described herein, the synergistic effects of positioning the center of gravity heel-ward and directing the shaft axis toe-ward from the center of gravity may provide a number of performance benefits, including enhanced face rotation dynamics, improved stability on off-center strikes, and increased feel and control. These performance benefits may impart versatility to the golf club head, making the golf club head a suitable choice for many golfers, particularly those who struggle with squaring the face at impact. The apparatus, methods, and articles of manufacture described herein are not limited in this regard.

The filler materials described herein may include, but are not limited to, one or more polymer materials. In one example, the filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, the filler material may be one or more thermoset polymers having bonding properties (e.g., one or more adhesive or epoxy materials). The filler material may also absorb shock, isolate vibration, and/or dampen noise when the golf club head 100 strikes a golf ball. Further, the filler material may be an epoxy material that may be flexible or slightly flexible when cured. In another example, the filler material may include any of the 3M™ Scotch-Weld™ DP100 family of epoxy adhesives (e.g., 3M™ Scotch-Weld™ Epoxy Adhesives DP100, DP100 Plus, DP10ONS and DP100FR), which are manufactured by 3M corporation of St. Paul, Minnesota. In another example, the filler material may include 3M™ Scotch-Weld™ Epoxy Adhesive DP100 Plus Clear. In another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In another example, the filler material may be LOCTITE® materials manufactured by Henkel Corporation, Rocky Hill, Connecticut. In another example, the filler material may be a polymer material such as an ethylene copolymer material that may absorb shock, isolate vibration, and/or dampen noise when a golf club head strikes a golf ball via the face portion. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with Dupont™ High-Performance Resin (HPF) family of materials (e.g., Dupont™ HPF AD1172, Dupont™ HPF AD1035, DuPont® HPF 1000 and Dupont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience, i.e., relatively high coefficient of restitution (COR). In another example, the filler material may be formed from one or more metals or metal alloys, such as aluminum, copper, zinc, and/or titanium. A filler material not specifically described in detail herein may include one or more similar or different types of materials described herein. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all of the heating and cooling processes may be performed by using heating or cooling systems that employ conveyor belts that move a golf club head described herein through a heating or cooling environment for a period of time as described herein. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods, and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion comprising a toe portion with a toe edge, a heel portion with a heel edge, a front portion, a rear portion, a top portion, a sole portion, a face portion at the front portion, and a leading edge between the sole portion and the face portion, the leading edge comprising a midpoint located halfway between the toe edge and the heel edge;

an alignment aid at the top portion, the alignment aid coinciding with a center longitudinal plane, the center longitudinal plane bisecting the body portion to define the toe portion and the heel portion;

a center of gravity located on a horizontal plane, the horizontal plane being parallel to a ground plane and intersecting the center longitudinal plane;

a coordinate system comprising:

an origin at the midpoint of the leading edge;

an x-axis through the origin and extending in a heel-to-toe direction;

a y-axis through the origin and extending in a sole-to-top direction; and a z-axis through the origin and extending in a front-to-rear direction; and a hosel portion at or proximate the heel portion, the hosel portion comprising:

a neck portion configured to lean in a toe-ward direction and a rearward direction;

a tip portion configured to attach to a shaft comprising a shaft axis, the tip portion located above the neck portion and configured to lean in a heel-ward direction and a frontward direction;

a bend portion between the neck portion and the tip portion;

a first angle formed between the neck portion and the tip portion in an x-y plane; and a second angle formed between the neck portion and the tip portion in a y-z plane, the second angle being different from the first angle, wherein the hosel portion is configured to impart forward lean to the shaft and orient the shaft such that the shaft axis intersects the horizontal plane at an intersection point that is offset from the center of gravity along the x-axis, wherein a visibility angle is formed between the center longitudinal plane and a visibility plane, the visibility plane bordering a toe-most extent of the bend portion and intersecting the center longitudinal plane at the alignment aid, wherein the visibility angle represents a range of sight-lines that enable an individual to fully see the alignment aid at an address position, and wherein the visibility angle is greater than or equal to 5 degrees and less than or equal to 20 degrees.

2. A golf club head as defined in claim 1, wherein the first angle is greater than or equal to 125 degrees and less than or equal to 140 degrees, and wherein the second angle greater than or equal to 163 degrees and less than or equal to 178 degrees.

3. A golf club head as defined in claim 1, wherein the center of gravity and the intersection point are separated by an offset distance along the x-axis, the offset distance being greater than or equal to 0.140 inches (3.556 mm) and less than or equal to 0.260 inches (6.604 mm).

4. A golf club head as defined in claim 1, wherein the center of gravity and the intersection point have zero offset along the y-axis and the z-axis.

5. A golf club head as defined in claim 1, wherein the intersection point is located toe-ward from the center of gravity.

6. A golf club head as defined in claim 1, wherein a lie angle between the shaft axis and the ground plane is greater than or equal to 60 degrees and less than or equal to 80 degrees.

7. A golf club head as defined in claim 1, wherein a ratio between a moment of inertia about a vertical axis of the center of gravity and a moment of inertia about the shaft axis is greater than or equal to 0.80 and less than or equal to 1.20.

8. A golf club head comprising:

a body portion comprising a toe portion, a heel portion, a front portion, a rear portion, a top portion, a sole portion;

an alignment aid at the top portion, the alignment aid coinciding with a center longitudinal plane, the center longitudinal plane bisecting the body portion to define the toe portion and the heel portion;

a center of gravity located on a horizontal plane, the horizontal plane being parallel to a ground plane and intersecting the center longitudinal plane; and a hosel portion coupled to the body portion, the hosel portion comprising:

a neck portion configured to lean in a toe-ward direction and a rearward direction;

a tip portion configured to attach to a shaft comprising a shaft axis, the tip portion located above the neck portion and configured to lean in a heel-ward direction and a frontward direction, wherein the hosel portion is configured to impart forward lean to the shaft and orient the shaft such that the shaft axis intersects the horizontal plane at an intersection point that is offset from the center of gravity, wherein a visibility angle is formed between the center longitudinal plane and a visibility plane, the visibility plane bordering a toe-most extent of the hosel portion and intersecting the center longitudinal plane at the alignment aid, wherein the visibility angle represents a range of sight-lines that enable an individual to fully see the alignment aid at an address position, and wherein the visibility angle is greater than or equal to 5 degrees and less than or equal to 20 degrees.

9. A golf club head as defined in claim 8, wherein the center of gravity is located heel-ward of the center longitudinal plane and the intersection point is located toe-ward of the center longitudinal plane, and wherein the center of gravity and the intersection point are equidistant from the center longitudinal plane.

10. A golf club head as defined in claim 8, wherein the hosel portion is integral with the body portion.

11. A golf club head as defined in claim 8, wherein the alignment aid is configured as a line.

12. A golf club head as defined in claim 8, wherein the center of gravity and the intersection point have zero offset in a front-to-rear direction and a sole-to-top direction.

13. A golf club head as defined in claim 8, wherein a lie angle between the shaft axis and the ground plane is 70 degrees, and wherein the visibility angle is greater than or equal to 10 degrees and less than or equal to 16 degrees.

14. A golf club head as defined in claim 8, wherein a ratio between a moment of inertia about a vertical axis of the center of gravity and a moment of inertia about the shaft axis is 1 or approximately 1.

15. A golf club head comprising:

a body portion comprising a toe portion, a heel portion, a front portion, a rear portion, a top portion, a sole portion;

an alignment aid at the top portion, the alignment aid coinciding with a center longitudinal plane, the center longitudinal plane bisecting the body portion to define the toe portion and the heel portion;

a center of gravity located on a horizontal plane, the horizontal plane being parallel to a ground plane and intersecting the center longitudinal plane; and a hosel portion at the heel portion and configured to attach to a shaft comprising a shaft axis, the hosel portion comprising a bend portion defining a toe-most extent of the hosel portion, wherein the hosel portion is configured to impart forward lean to the shaft and orient the shaft such that the shaft axis intersects the horizontal plane at an intersection point that is offset from the center of gravity, wherein a visibility angle is formed between the center longitudinal plane and a visibility plane, the visibility plane bordering the bend portion and intersecting the center longitudinal plane at the alignment aid, wherein the visibility angle represents a range of sight-lines that enable an individual to fully see the alignment aid at an address position, and wherein the visibility angle is less than or equal to 20 degrees.

16. A golf club head as defined in claim 15, wherein the intersection point mirrors or substantially mirrors the center of gravity about the center longitudinal plane.

17. A golf club head as defined in claim 15, wherein the intersection point is located toe-ward from the center of gravity, and wherein the center of gravity and the intersection point are separated by an offset distance greater than or equal to 0.180 inches (4.572 mm) and less than or equal to 0.220 inches (5.588 mm) in a heel-to-toe direction.

18. A golf club head as defined in claim 15, wherein the alignment aid is configured as a recessed line.

19. A golf club head as defined in claim 15, wherein a lie angle between the shaft axis and the ground plane is greater than or equal to 75 degrees and less than or equal to 80 degrees, and wherein the visibility angle is greater than or equal to 0.5 degrees and less than or equal to 2 degrees.

20. A golf club head as defined in claim 15, wherein a ratio between a moment of inertia about a vertical axis of the center of gravity and a moment of inertia about the shaft axis is greater than or equal to 0.80 and less than or equal to 1.20.

* * * * *